US012669316B1

(12) United States Patent
Jankowski et al.

(10) Patent No.: US 12,669,316 B1
(45) **Date of Patent: *Jun. 30, 2026**

(54) CONTROL ACTUATION SYSTEM, DEVICES AND METHODS FOR MISSILES, MUNITIONS AND PROJECTILES

(71) Applicant: Orbital Research Inc., Cleveland, OH (US)

(72) Inventors: Michael Jankowski, Winter Garden, FL (US); Anthony Opperman, Wickliffe, OH (US); Vincent Cozza, Potomac, MD (US)

(73) Assignee: Orbital Research Inc., Cleveland, OH (US)

( * ) Notice: Subject to any disclaimer, the term of this patent is extended or adjusted under 35 U.S.C. 154(b) by 755 days.

This patent is subject to a terminal disclaimer.

(21) Appl. No.: 17/475,655

(22) Filed: Sep. 15, 2021

Related U.S. Application Data

(63) Continuation of application No. 15/631,272, filed on Jun. 23, 2017, now Pat. No. 11,150,062.

(60) Provisional application No. 62/353,829, filed on Jun. 23, 2016.

(51) Int. Cl.
*F42B 10/14* (2006.01)
*F42B 10/64* (2006.01)
*F42B 15/01* (2006.01)

(52) U.S. Cl.
CPC ..... *F42B 10/14* (2013.01); *F42B 10/64* (2013.01); *F42B 15/01* (2013.01)

(58) Field of Classification Search
CPC ..... F42B 10/14–20; F42B 15/01
See application file for complete search history.

(56) References Cited

U.S. PATENT DOCUMENTS 6,056,237 A * 5/2000 Woodland ..... F42B 12/365 244/49
6,237,496 B1 * 5/2001 Abbott ..... F42B 10/64 244/3.14
6,685,143 B1 * 2/2004 Prince ..... G05D 1/0088 244/203
7,947,936 B1 * 5/2011 Bobinchak ..... F41G 3/04 701/1
7,963,442 B2 * 6/2011 Jenkins ..... F42B 15/01 235/404
8,189,345 B2 * 5/2012 Rapp ..... F42B 30/006 361/747
8,338,769 B1 * 12/2012 Sankovic ..... B63B 32/66 244/49
8,410,412 B2 * 4/2013 Geswender ..... G02B 7/022 244/3.21

(Continued)

*Primary Examiner* — Joseph W Sanderson
(74) *Attorney, Agent, or Firm* — Brian Kolkowski

(57) ABSTRACT

Systems and methods are presented for control of munitions, missiles and projectiles in flight and more particularly with the use of activatable or deployable flow effectors that remain stowed or inactive during launch or firing, and can be actuated after launch or firing on demand. More specifically, systems and methods are presented for control of munitions, missiles, and projectiles by activating and/or deactivating a control actuation system (CAS) based on measurements of an inertial measurement unit (IMU) and sensors integrated into such IMU, the IMU and sensors being at least part of a configurable guidance sensor suite (CGSS).

14 Claims, 13 Drawing Sheets

(56) References Cited

U.S. PATENT DOCUMENTS

| | | | | |
|---|---|---|---|---|
| 8,426,788 | B2 * | 4/2013 | Geswender | F42B 15/01 244/3.21 |
| 8,552,349 | B1 * | 10/2013 | Alexander | F41G 7/346 701/470 |
| 8,921,749 | B1 * | 12/2014 | Scott | F42B 10/14 244/3.28 |
| 9,086,258 | B1 * | 7/2015 | Vasudevan | F42B 30/10 |
| 9,207,049 | B2 * | 12/2015 | Rovinsky | F41G 7/303 |
| 11,150,062 | B1 * | 10/2021 | Jankowski | F42B 10/64 |
| 2010/0296258 | A1 * | 11/2010 | Geswender | H05K 1/144 361/803 |
| 2011/0180655 | A1 * | 7/2011 | Deschatre | F42B 10/14 244/3.28 |
| 2012/0017795 | A1 * | 1/2012 | Dryer | F42B 10/16 102/517 |
| 2012/0175458 | A1 * | 7/2012 | Geswender | F42B 10/64 102/275.9 |
| 2012/0175459 | A1 * | 7/2012 | Geswender | G02B 7/022 102/275.9 |
| 2012/0175460 | A1 * | 7/2012 | Palani | F42B 10/14 244/3.28 |
| 2014/0203134 | A1 * | 7/2014 | Plumer | F42B 10/20 244/3.1 |
| 2014/0291441 | A1 * | 10/2014 | Bellotte | F02K 9/976 244/3.28 |
| 2015/0143982 | A1 * | 5/2015 | Rovinsky | F41G 7/303 89/1.11 |
| 2015/0247714 | A1 * | 9/2015 | Teetzel | F42B 15/36 244/3.21 |
| 2016/0231089 | A1 * | 8/2016 | Rovinsky | F41G 7/30 |
| 2016/0273880 | A1 * | 9/2016 | Dryer | F42C 13/04 |

* cited by examiner

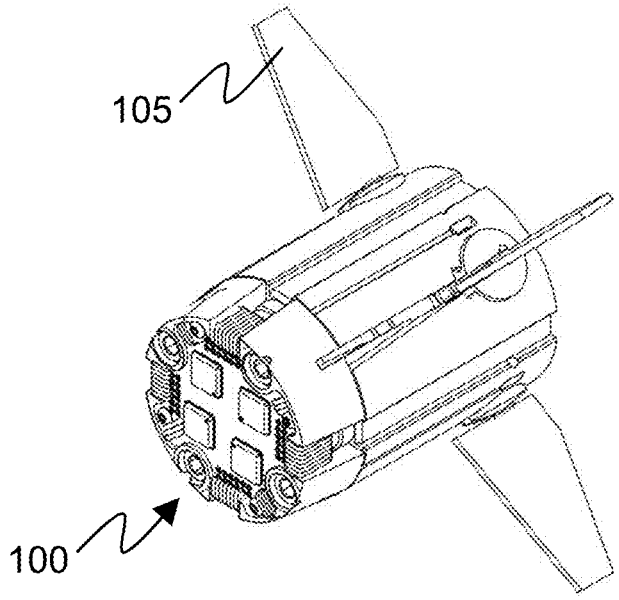
FIG. 1A
FIG. 1B
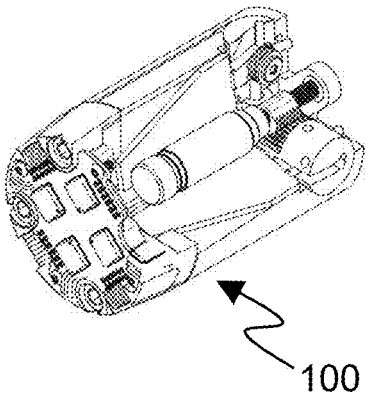
FIG. 1C
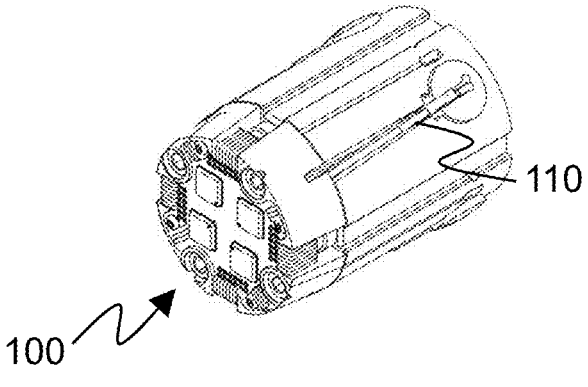

| | 10 | 9 | 8 | 7 | 6 | 5 | 4 | 3 | 2 | 1 |
|---|---|---|---|---|---|---|---|---|---|---|
| A | VBAT | PC13 | PDR_ON | BOOT0 | PB4 | PD7 | PD4 | PC12 | PA14 | VDD |
| B | PC14 | PC15 | VDD | PB7 | PB3 | PD6 | PD2 | PA15 | PI1 | VCAP_2 |
| C | PA0 | VSS | PB9 | PB6 | PD5 | PD1 | PC11 | PI0 | PA12 | PA11 |
| D | PC2 | BYPASS_REG | PB8 | PB5 | PD0 | PC10 | PA13 | PA10 | PA9 | PA8 |
| E | PC0 | PC3 | VSS | VSS | VDD | VSS | VDD | PC9 | PC8 | PC7 |
| F | PH0 | PH1 | PA1 | VDD | PE10 | PE14 | VCAP_1 | PC6 | PD14 | PD15 |
| G | NRST | VDDA | PA5 | PB0 | PE7 | PE13 | PE15 | PD10 | PD12 | PD11 |
| H | VSSA | PA3 | PA6 | PB1 | PE8 | PE12 | PB10 | PD9 | PD8 | PB15 |
| J | PA2 | PA4 | PA7 | PB2 | PE9 | PE11 | PB11 | PB12 | PB14 | PB13 |

FIG. 13A
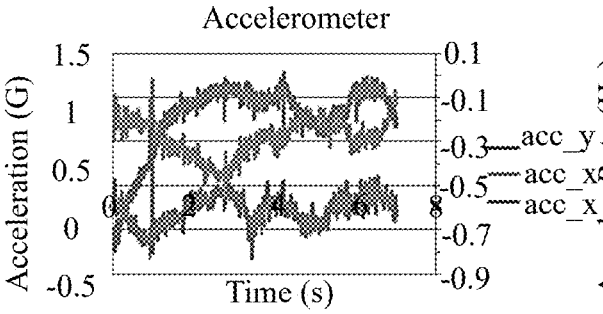
FIG. 13B
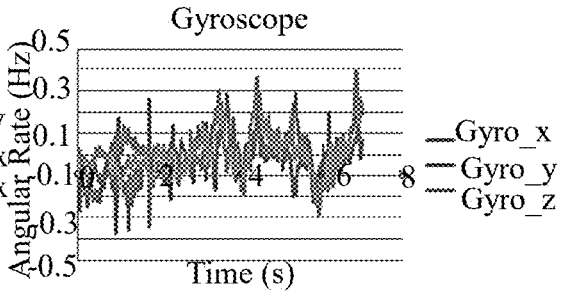
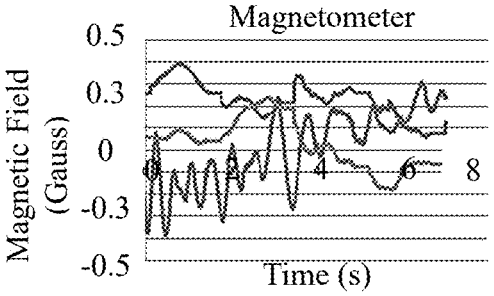
FIG. 13C
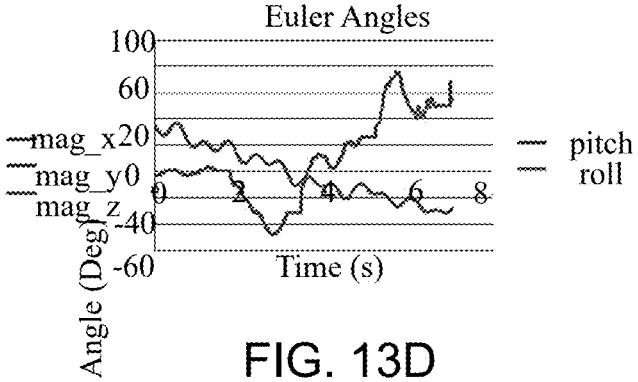
FIG. 13D
FIG. 14A
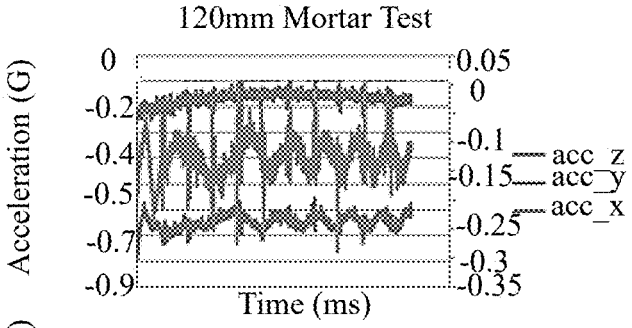
FIG. 14B
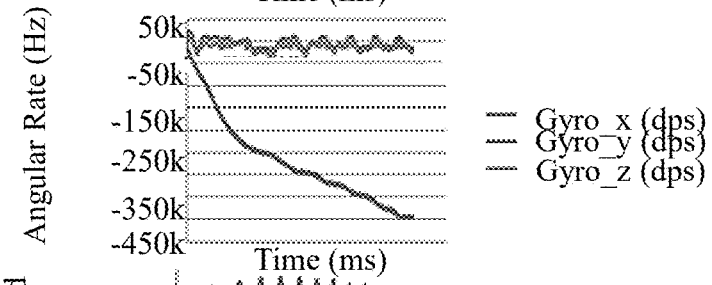
FIG. 14C
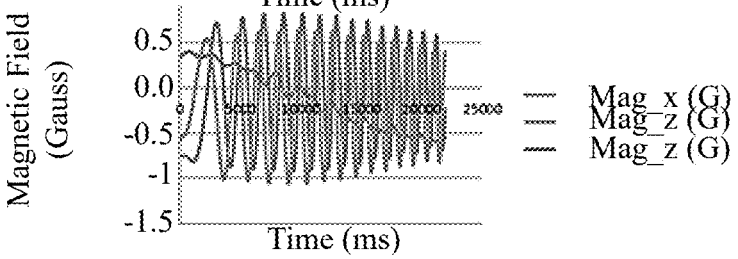

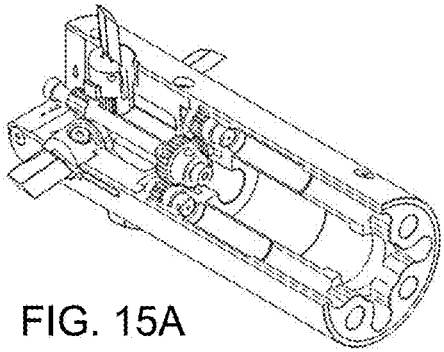
FIG. 15A
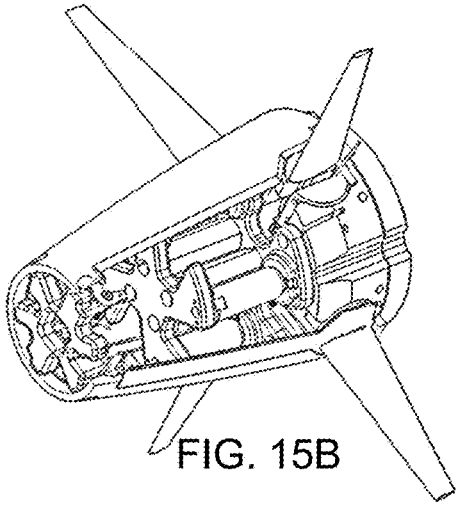
FIG. 15B
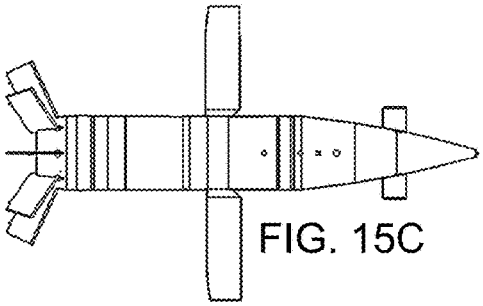
FIG. 15C
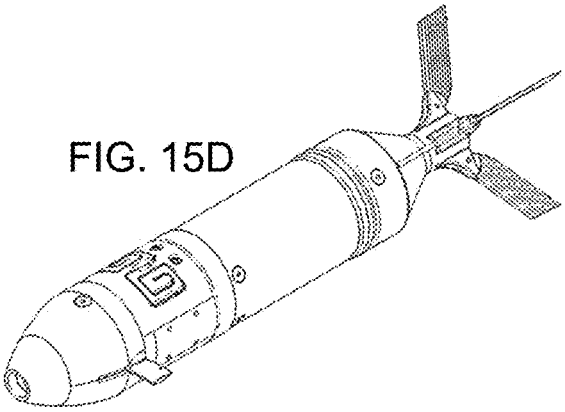
FIG. 15D
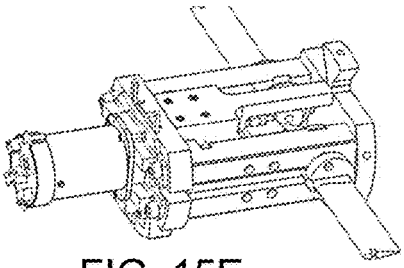
FIG. 15E
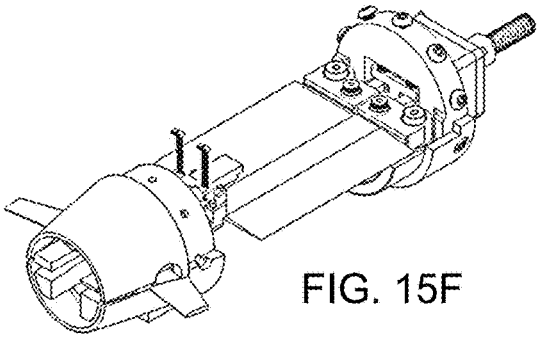
FIG. 15F
FIG. 15G
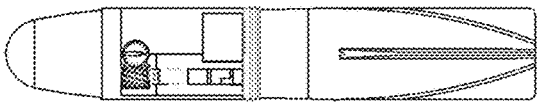

CONTROL ACTUATION SYSTEM, DEVICES AND METHODS FOR MISSILES, MUNITIONS AND PROJECTILES

CROSS-REFERENCE TO RELATED APPLICATIONS

This application is a continuation of U.S. patent application Ser. No. 15/631,272, which was filed on Jun. 23, 2017 as a non-provisional application that claims the benefit of prior-filed provisional U.S. Patent Application Ser. No. 62/353,829, which was filed on Jun. 23, 2016. The specifications and drawings of each of the above patents and applications are hereby incorporated by reference in their entirety.

BACKGROUND OF THE INVENTION

1. Field of the Invention

The present invention relates to the control of munitions, missiles and projectiles, in flight. The present invention further relates to controlling munitions, missiles and projectiles in flight with the use of activatable or deployable flow effectors that remain stowed or inactive during launch or firing, and can be actuated after launch or firing on demand. The present invention further relates to controlling the munitions, missiles and projectiles based on measurements of an inertial measurement unit (IMU) and sensors integrated into such IMU.

2. Technical Background

Currently, weapon systems that offer precision guidance, situational awareness, and extended range are either unavailable due to technology gaps or limited due to cost. Dramatically increasing range, maneuver footprint and situational awareness at a lower size, weight, power and cost (SWaP-Cost) is essential to maintaining operational/technological overmatch for the US Army. Further, the ever-evolving battlefield challenges the warfighter's ability to accurately acquire and prosecute a target while maintaining a safe distance from the adversary especially in a GPS denied environment.

This technology gap has been identified by the Department of Defense and several development efforts are underway to meet this squad-level need. To date, these other development efforts do not appear to be a viable squad-level solution given their need for additional hardware/electronics/power, size, weapon modifications, cost, etc. The warfighter is already challenged with logistics of transporting their supplies, munitions and weapons into the battlefield. Additional situational awareness and telemetry capabilities are needed at the squad-level to provide the warfighter with organic, real-time battlefield information while on the front line.

The present invention aims to allow squad members to defeat or suppress threats at extended ranges in defilade, increase effective probability of defeating or suppressing threats without adding to the warfighter's load out. Key to meeting the warfighter's need is to ensure the solution can be widely implemented, is ready-to-use and affordable. The present invention's precision guidance and situational awareness sub-system technologies are designed to be fully integrated into existing and known rounds, munitions, missiles or projectiles and fired from existing weapons systems (e.g., 40 mm grenade, 120 mm mortar, etc.). Further, the present invention does not require any additional power or weapon accessories. The present invention provides the warfighter with increased lethality and situational awareness in a GPS denied environment.

Additionally, future battlefield threats include miniature unmanned aerial systems (UAS's). These commercially available UAS's can become lethal weapons in the battlefield when carrying explosive payloads or monitoring the whereabouts of US servicemen. Given the present invention's steering and situational awareness systems can be integrated into an existing or known round, these precision guided projectiles are envisioned as a counter-UAS technology that will deliver kinetic and non-kinetic effects to target at a safe distance from the warfighter.

Currently, man portable weapon systems that offer precision guidance and extended range to defeat threats in defilade are unavailable to the warfighter. Dramatically increasing range, maneuver footprint and situational awareness at a lower SWaP and Cost is essential to maintaining operational/technological overmatch for the US Army, especially at the squad-level. Further, the ever-evolving battlefield challenges the warfighter's ability to accurately acquire and prosecute a target while maintaining a safe distance from the adversary especially in a GPS denied environment. Thus, precision guidance is needed to improve the accuracy of existing grenades, mortars, and artillery by correcting the trajectory of projectiles in flight to their designated target location which will effectively reduce target delivery error and reducing the number of rounds required to conduct a fire mission.

Therefore, it is an object of the present invention to provide a scalable Control Actuation System (CAS), Configurable Guidance Sensor Suite (CGSS) with situational awareness and telemetry (Transceiver). These systems can be used with 120 mm mortars (GEFM), a rocket assist 40 mm grenades, 155 mm artillery rounds (ERPT), and the like. It is further an object of the present invention to provide a CAS/CGSS/Transceiver subsystem integrated into traditional rounds to provide precision guidance, commanded maneuver, situational awareness and extended range. The present invention's modular and scalable CAS/CGSS/Transceiver subsystem modules will represent a significant advancement in affordable precision guidance.

SUMMARY OF THE INVENTION

The present invention includes CAS/CGSS/Transceiver that are enabling subsystems and coincide with other systems that include features and components including a) rugged, light-weight and low cost CAS, b) compact, guidance electronic unit with integrated IMU (CGSS), and c) power efficient situational awareness subsystem with telemetry for terminal guidance (Transceiver). These subsystems comprise a flexible architecture with the ability to be affordably scaled for integration with other weapon platforms. This modular design also has the capability to scale the number of control axes to increase the control authority (g's pulled by the round). The steering system can operate as a 2-channel CAS with roll-to-turn control or as a 4-channel CAS which utilizes skid-to-turn control. This flexibility, along with the low-cost nature of the design, lends itself to be integrated with other platforms currently under development. The present invention's CAS/CGSS/Transceiver may be scaled for these platforms in both the 2-channel and 4-channel configurations:

1. 120 mm 2-channel hybrid mortar
2. 120 mm 4-channel mortar (GEFM)

3. 40 mm 4-channel, rocket-assist grenade 4. 155 mm 2-channel artillery (ERPT)

The CAS/CGSS/Transceiver of the present invention impart the control authority needed on these additional platforms to enhance precision-guidance and range extension capabilities while being able to operate in a GPS denied environment. To accomplish these objectives, the CAS/IMU/Transceiver is a) integrated into these 4 platforms, b) performance potential confirmed via hardware in the loop evaluation, c) durability proven through environmental survivability testing, and d) ultimately validated during live fire tests which will demonstrate survivability at each unique charge level, control authority while in flight and range extension.

Control Actuation Systems (CASs) are utilized to create the control authority to maneuver the round or extend the range. The present invention provides a modular CAS design that allows unique/custom features to be implemented on CASs targeted for other sized platforms to meet different performance requirements. Key scalable features include the retention, deployment and locking mechanisms of the canards, the orientation and gearing of the motors to manipulate the canards and the standard I/O configuration (s). These scalable features also enable the CAS to be designed with 2, 3 or 4 canards or channels, or other flow effectors of control surfaces. Even though the cost may increase as the CAS changes from a 2-channel CAS to a 4-channel CAS, the maneuverability dramatically increases as well as applicability to multiple other platforms. By changing the number of control surfaces, it also changes the type of control strategy from roll-to-turn control with the 2-channel CAS to skid-to-turn control with the 4-channel CAS. By successfully demonstrating these forms of maneuvering, the control architecture also becomes modular and scalable to other weapon platforms.

The present invention utilizes a CAS comprising a DC motor, planetary gear and encoder that interfaces with a lead-screw design that provides high slew rates and high torque at various bandwidths for different applications. The motor may be a brushless DC (BLDC) motor, or a brushed (BDC) motor. The lead-screw comprises a customized nut and a gear profile machined into the canard barrel that allow the system to minimize the backlash of the CAS and modify as required to balance the torque, slew rates, and positional accuracy of the design when subjected to high-g/high-spin. The design of the gear interface is robust enough to withstand the high-vibratory and high-g launch environment, so that the contact tolerances remain intact and minimize alignment or frictional errors which may degrade performance.

The IMU/CGSS of the present invention is also scalable to larger caliber projectiles. The IMU is preferably integrated with the CAS to provide the GNC outputs required to accurately maneuver the projectile. The IMU has a basic architecture to allow interface communication with a variety of IMU sensors, motor controllers/drivers and power supply buses, etc. This flexibility allows the present invention to integrate the IMU with many known projectile rounds including, but not limited to, 40 mm and 120 mm precision-guided projectiles, and 155 mm ERPT. The IMU design will be scaled for the platforms discussed above, as well as increase its performance. Table 1 shows the performance of the IMU.

TABLE 1

Performance of IMU/CGSS after SPII

| Category | Option-Tier-1 (MC18SPA) | Option-Tier-2 (MC35SPB) |
|---|---|---|
| Gyroscope Rate Range (dps) | X = +/− 20,000<br>Y/Z = +/− 250 − 2,000 | X = +/− 20,000<br>Y/Z = +/− 2,000 |
| Accelerometer Range min (G) | X/Y/Z = +/− 16 | X/Y/Z = +/− 16 |
| Accel/Gyro Bandwidth min (Hz) | Accel = 1130,<br>Gyro = 8800 | Accel = 260,<br>Gyro = 256 |
| Measurement Latency | TBD | TBD |
| Gyro Bias Instability/Noise Floor (dph) | 10 | 5 |
| Gyro Bias Stability (dph) | 15 | <10 |
| Gyro ARW (deg/s/rthr) | 1.2 | 0.8 |
| Gyro Noise RMS, 100 Hz BW (dps) | 0.1, (92Hz BW) | 0.05 |
| Gyro SF Error (ppm) | 400 | 250 |
| Gyro SF Asym Error (ppm) | 400 | 250 |
| Gyro Misalignment (mrad) | 1.0 | 0.87 |
| Gyro Non-Orthog (mrad) | 0.5 | <0.01 |
| Gyro G Sens Bias (deg/hr/G) | ~5 | ~3 |
| Gyro VRE (deg/hr/Grms) | 200 | 150 |
| Accel Bias Instability/Noise Floor (mG) | 0.01 | 0.005 |
| Accel Bias Stability (mG) | <0.1 | <0.04 |
| Accel VRW (mG) | 0.5 | 0.06 |
| Accel Noise RMS, 100 Hz BW | 8.0, (94 Hz BW) | |
| Accel SF Error (ppm) | 300 | 250 |
| Accel SF Asym Error (ppm) | 300 | 250 |
| Accel Misalignment (mrad) | 1.0 | 0.87 |
| Accel Non-Orthog (mrad) | 0.5 | <0.01 |
| Accel VRE (mG/Grms) | 60 $mg/g^2$ | 50 $mg/g^2$ |
| Mag Range (Gauss) | +/− 48 | +/− 2.5 |
| Mag Bandwidth min (Hz) | 250 | 200 |
| Mag Bias (nTesla) | 0.01 | 0.01 |
| Mag SF Error (ppm) | <0.1% | <0.1% |
| Mag Misalignment (mrad) | 1.0 | 0.87 |
| Mag Non-Orthog (mrad) | 0.5 | <0.01 |

The present invention further utilizes an IMU comprising a sensor suite of preferably several sensors used to provide measurements including, but not limited to, body rates, linear accelerations and magnetic disturbance data measurements useful for providing precise navigation and control of the munitions, missiles or projectiles. The IMU of the present invention may be used as a standalone IMU, or can be integrated into a guidance electronic unit (GEU)/IMU to be utilized with a CAS, such as described herein. The IMU preferably comprises one or more sensors in various combinations, such sensors including, but not limited to accelerometers, gyroscopes, magnetometers, GPS sensors and separate integrated sensor suites. Further, the systems of the present invention utilize a range of sensors for maneuvering or stabilizing the round during flight. The sensors, for example, may be used to determine the round's relative position with respect to a moving target or target location, the flow dynamics on the round's flow surface, and threats or obstacles in or around the round. The sensors for determining the round's relative position may include but are not limited to antennas for acquiring global positioning (GPS as mentioned above), magnetic sensors, solar detectors, and the like. The sensors for determining the flow dynamics may include but are not limited to a static and/or dynamic pressure sensor, shear stress sensor (hot film anemometer, a direct measurement floating-element shear stress sensor), inertial measurement unit or system, and other sensors known to those skilled in the art whose signal could be used to estimate or determine flow condition such as separation on the surface of the round, which would function as a trigger point for actuating the activatable flow effectors or active flow control devices or deploying the deployable flow effectors. The sensors for determining threats or obstacles in or around the aircraft or missile include but are not limited to radar detectors, laser detectors, chemical detectors, heat (or infrared) detectors, and the like. The sensors most useful for determining round flight parameters include accelerometers, magnetometers, IR sensors, rate gyros, and motor controller sensors.

The IMU further preferably comprises a processor or controller, more preferably a microcontroller, to integrate and process the sensor signals in order to supply output data related to the conditions measured by the sensors. The processor or controller can be predictive or can respond and actuate the activatable flow effectors or deploy the deployable flow effectors based on current conditions. The controller preferably utilizes one or more digital microprocessors to process signals provided by the various sensors and deliver deployment, activation, or actuation commands to the deployable flow effectors, activatable flow effectors or active control surfaces of the present invention. Preferably, the present invention utilizes at least one gyroscope, at least one accelerometer and at least one separate integrated sensor package consisting of at least one or more of these same types of sensors, thus providing redundancy. This redundancy in sensor(s) serves at least two beneficial purposes. First, it allows for a significant increase in precision with the customized separate sensor package but in a reduced sensor range (for example +/−16G, 2,000 dps). The firmware of the IMU is designed in such a manner that it will be able to adaptively switch between the separate integrated sensor package and the direct accelerometer/gyroscope combination in the IMU at the onset of saturation of each of the sensor's dynamic range. Second, this redundancy allows for an overdetermined system when used to estimate the state/orientation of the projectile. The outputs provided by the additional sensors are always available so that a robust, consistent solution will exist based on IMU outputs. The combination of individual sensors and the separate integrated sensor package allows the present invention to reduce footprint and increase capabilities of the IMU. An additional gyroscope may further be integrated to capture the high-spin environment prior to controlled flight. The IMU will be capable of adaptively transitioning between the gyroscope on separate integrated sensor package and that directly on the IMU.

The present invention still further utilizes, in many embodiments, a transceiver for communicating information between the fired munition, missile or projectile and a user. The transceiver is designed to send key information back to the user (e.g., warfighter), which can include images/video (EO/IR) and/or flight data (attitude, velocity, position, time of flight, etc.). This information is needed for target identification and prioritization. The transceiver is designed to be scalable for multiple caliber weapons or other platforms with varying CONOPS. For example, the transceiver can be integrated with imaging technology in a low velocity 40 mm round to provide the user with target detection, identification and tracking. Or, the transceiver can be integrated into a 40 mm surveillance/observation round in order to provide the user strategic battlefield information including assessing battle damage. In this example, the imaging technologies, power management and integration information can be scaled among these varying applications. Other applications include communicating with UAVs/drones, performing target prioritization in flight and offering situational awareness information to the user. Some embodiments utilize a situational awareness subsystem comprising the at least one image or video sensor and the transceiver, the situation awareness subsystem adapted to transmit the real-time image or video data via the transceiver to a user to provide terminal guidance to the missile, munition, or projectile via the remote user interface. Preferably, the transceiver is a radio frequency (RF) transceiver that operates under a frequency-hopping spread spectrum (FHSS) method that rapidly changes and switches communication among a number of frequencies or channels in a pseudorandom sequence that is shared and known by both the transceiver and the remote interface. FHSS is a wireless technology that spreads its signal over rapidly changing frequencies. Each available frequency band is divided into sub-frequencies. Signals rapidly change ("hop") among these in a pre-determined order. Interference at a specific frequency will only affect the signal during that short interval. Further, the transceiver preferably communicates image and/or flight data in real-time. This real-time communication allows a remote user the ability to take control of the munition, missile or projectile and perform user-controlled flight from a remote location. The user is fed the image and flight data from the round in-flight, and through a user interface, send live commands or controls back to the round in flight to guide, maneuver or otherwise control the round.

TABLE 2

High-level characteristics of IMU

| Characteristic | Value |
|---|---|
| Diameter (mm) | 33 |
| Height (mm) | 12 |
| Voltage (VDC) | 3.3 |
| Current (A) | 0.065 |
| Mass (g) | <30 |
| Output Data Rate(s) (Hz) | 1,000 |
| Activation Time (s) | TBD 0.5 |
| Sensor Start Time (s) | TBD 0.5 |
| Measurement Latency (s) | TBD 3 msec |

Table 3 provides performance estimates for gyroscopes within various embodiments of the present invention.

TABLE 3

Performance for Gyroscopes

| Parameter | Performance |
|---|---|
| Bandwidth (Hz @ Phase <90 deg) | 256 |
| Scale Factor – X/Y/Z (ppm) | 250 |
| Scale Factor Asymmetry (ppm) | 250 |
| G Sensitive Bias (deg/hr/G) | 30 |
| Misalignment (mrad) | 0.87 |
| Non-Orthogonality (mrad) | 0.1 |
| Bias Stability – min 60 s (deg/hr) | <10 |
| ARW – X/Y/Z (deg/√hr) | 0.8 |
| Output Noise – RMS (100 Hz BW) (deg/s) | 0.035 |
| VRE – X/Y/Z (deg/hr/Grms) | 30/30/30 |
| Operating Rate – X/Y/Z (deg/s) | 2,000/2,000/2,000 |

Table 4 provides performance estimates for accelerometers within various embodiments of the present invention.

TABLE 4

| Performance for Accelerometers | |
|---|---|
| Parameter | Performance |
| Bandwidth (Hz @ Phase <90 deg) | 260 |
| Scale Factor (ppm) | 250 |
| Scale Factor Asymmetry (ppm) | 250 |
| Misalignment (mrad) | 0.87 |
| Non-Orthogonality (mrad) | 0.1 |
| Bias Stability – min 60 s (mG) | 0.4 |
| VRW – X/Y/Z (deg/hr/Grms) | 0.6 |
| Output Noise (RMS (100 Hz BW) | 0.14 |
| VRE (mG/G$^2$) | <0.5 |
| Operating Accel. (G) | 16 |

Table 5 provides performance estimates for magnetometers within various embodiments of the present invention.

TABLE 5

| Performance for Magnetometers | |
|---|---|
| Parameter | Performance |
| Bandwidth (Hz @ Phase <90 deg) | 200 |
| Bias – (mGauss) | 10 |
| Scale Factor Error (ppm) | 700 |
| Misalignment (mrad) | 0.14 |
| Non-Orthogonality (mrad) | <0.5 |
| Noise – RMS (Gauss) | 1.9 |
| Magnetic Range (Gauss) | 2.5 |

Table 6 provides performance estimates for roll-gyroscopes within various embodiments of the present invention.

TABLE 6

| Performance for Roll-Gyroscopes | |
|---|---|
| Parameter | Performance |
| Bandwidth (Hz @ Phase <90 deg) | 256 |
| Scale Factor – X/Y/Z (ppm) | 2200 |
| Scale Factor Asymmetry (ppm) | 2,000 |
| G Sensitive Bias (deg/hr/G) | 50 |
| Misalignment (mrad) | 1.5 |
| Non-Orthogonality (mrad) | 1.0 |
| Bias Stability – min 60 s (deg/hr) | 40 |
| ARW – X/Y/Z (deg/√hr) | 3.75 |
| Output Noise – RMS (100 Hz BW) (deg/s) | 0.05 |
| VRE – X/Y/Z (deg/hr/Grms) | 50 |
| Operating Rate – X/Y/Z (deg/s) | 4,000 |

Table 7 provides performance estimates for AD-accelerometers within various embodiments of the present invention.

TABLE 7

| Performance for AD-Accelerometers | |
|---|---|
| Parameter | Performance |
| Bandwidth (Hz @ Phase <90 deg) | 400 |
| Scale Factor (ppm) | 2,000 |
| Scale Factor Asymmetry (ppm) | 1,000 |
| Misalignment (mrad) | 1.47 |
| Non-Orthogonality (mrad) | 0.7 |
| Bias Stability – min 60 s (mG) | 0.4 |
| VRW – X/Y/Z (deg/hr/Grms) | 0.6 |

TABLE 7-continued

| Performance for AD-Accelerometers | |
|---|---|
| Parameter | Performance |
| Output Noise (RMS (100 Hz BW) | 1.4 |
| VRE (mG/G$^2$) | 0.5 |
| Operating Accel. (G) | 55 |

Table 8 provides performance characteristics for various sensors that may be used with the IMU of the present invention providing a baseline level of performance for development of the IMU.

TABLE 8

| Performance Characteristics of IMU sensors, configuration used for baseline development of IMU. | |
|---|---|
| Characteristic | Value |
| Accelerometer range (G) | 50,000 (X-shock), 16 g X/Y/Z |
| Gyroscope (dps) | 50,000 dps (X), 2,000 Y/Z |
| Magnetometer (Gauss) | 48 |
| G-survivability (G) | 25 kG (Field), 40 kG (Lab) |

Many other features of various embodiments of the present invention are novel or aid in the utility of the various embodiments of the present invention. The present invention may be constructed of custom alloys and/or composites to reduce the overall weight of the weapon platform, and to optimize the strength to weight ratio. Numerous alloys or composites may be used including, but not limited to Elektron® or other alloys including magnesium, aluminum, zinc, and/or calcium in various configurations and concentrations, magnesium metal foam matrix, Garolite or other glass-based phenolic fiber-reinforced composites, or the like.

Flow effectors or control surfaces are stowed within the airframe so as to prevent premature deployment and only deploy on command. A novel deployment spring is utilized to attain full deployment of the flow effectors or control surfaces. The deployment spring is preferably recessed within the flow effector or control surface barrel and/or round. The deployment spring is preferably able to deploy in milliseconds.

In some embodiments the systems of the present invention utilize activatable flow effector or active flow control devices. The activatable flow effectors or active flow control devices of the present invention are unconventional flow surfaces that are electromechanical, electropneumatic, electrohydraulic, fluidic, and other types of devices, which can be used to create disturbances in the flow over the surface of the missile or aircraft. In some instances, preferably, the activatable flow effector or active flow control devices induce small disturbances, micro-vortices or perturbances in the vicinity or close proximity to the activatable flow effector or active flow control device. Further preferably, the activatable flow effector or active flow control device is flush or nearly flush, when deactivated, with the surface of the missile or aircraft to which it has been installed thereby creating little or no drag on the missile or aircraft when in an inactive state. In some instances, it is preferred that the activatable flow effector or active flow control devices have no hinged parts or surfaces. The activatable flow effector or active flow control devices of the present invention include but are not limited to active vortex generators, which are deployable, including but not limited to flow deflectors, balloons, microbubbles, and dimples or create active pressure active regions by suction or air pressure; synthetic jets including zero-net-mass synthetic jets; pulsed vortex generators; directed jets; vortex generating devices (fluidic and mechanical) plasma actuators including weakly ionized plasma actuators and single barrier dielectric discharge actuators; wall turbulators; porosity including but not limited to reconfigurable, inactive and active; microactuators; and thermal actuators.

The deployable flow effectors of the present invention may include deployable wings, canards, strakes, spoilers, body fins, tailfins/vertical stabilizers, tailplanes/horizontal stabilizers, and winglets. For the purposes of this application, these structures must be construed to have mutually exclusive meanings. For example, a canard is a forward-placed structure and/or control surface, oriented horizontally or at some small angle therefrom, placed ahead of a wing (or, in any case, forward of the center of gravity, where a wing would be) instead of behind it on an afterbody or tail, and is thus distinguished from a tailplane/horizontal stabilizer or a fin. These structures may comprise or may act as flaps, rudders, elevators, elevons, ailerons, and/or stabilators, as appropriate, each of which terms has a separate and distinct meaning in the art from the other terms and should not be blurred or confused when used in this application to claim or define certain structures. A person skilled in the art would appreciate that the named structures all function differently.

To prevent flow effector or control surface recoil, a locking pin is provided with a custom geometry. The tip of the locking pin may be tapered to allow easy entry into a channel which may be cut into the base of the flow effector or control surface. The pin may be spring actuated to force the locking pin to quickly slide into this channel and prevent the flow effector or control surface from recoiling and also firmly (i.e., with minimal play or slop) locking the flow effector or control surface in position with the flow effector or control surface barrel. The locking pin preferably includes a lock reset. The lock reset is preferably located within the flow effector or control surface barrel. The locking pin may hold the canard in place after deployment, and the reset assembly allows the canard to be retracted without having to disassemble the entire round.

A gear interface may be machined in such a manner to minimize slop or play in the system. The flow effector or control surface barrel is preferably precisely rotated to attain desired deflection angles. The flow effector or control surface barrel preferably integrates a gear and bearing where machined gear teeth are utilized to reduce size and weight.

A Hall Effect sensor may be utilized in some embodiments of the present invention. Such a sensor may be attached to or integrated with the flow effector or control surface barrel in order to measure the absolute position of the flow effectors or control surfaces.

Preferably, the control electronics, as well as many or all other components of the system, are g-hardened and distributed with a dedicated control circuit for each of the flow effectors or control surfaces. The control circuit preferably comprises one or more of a microcontroller, a motor control DSP, and a motor driver (full bridge) for either brushless or brushed DC motors.

The present invention preferably includes a retention piece to hold the flow effector or control surface barrel in place after assembly. The flow effector or control surface barrel can be slid into its space and rotated to be locked in so that it cannot fall out during operation. This prevents the flow effector or control surface barrel from coming out while still allowing for the flow effector or control surface barrel to rotate freely.

Preferably, the flow effector or control surface barrel/gear interfaces with a position component. In one preferred embodiment, the position component is a lead screw that comprises a lead screw nut. Other possible position component configurations include crank arm systems, trunnion systems, ball or other joint systems and the like. For purposed of the present invention, the position component will be primarily referred to in the lead screw embodiment, though other position components known to those skilled in the art will be readily ascertained. The lead screw nut may have rack teeth directly cut into the lead screw nut. The outer profile or geometry of the lead screw nut can be designed to help keep the lead screw nut properly oriented to transfer the torque. Sections may be removed from lead screws so that the pieces can be tightly integrated with one another in such a confined space. The lead screw nut is customized to directly drive the flow effector or control surface barrel/gear. The linear motion translates directly to directional motion and torque while minimizing inefficiencies in the transmission. The lead screw and lead screw nut further have the added benefit of preventing back-drive of the flow effectors or control surfaces once they have been deployed. Often, in conventional designs, aerodynamic forces exerted on the flow effectors or control surfaces cause the flow effectors or control surfaces to move back along the deployment path and move out of fully deployed positions. The lead screw and lead screw nut of the present invention helps to lock the flow effectors or control surfaces into place such that they remain in place even in the presence of extremely high aerodynamic forces subjected thereupon.

Preferably, the control electronics and motor share a common housing. This allows the use of a common heat sink between the motor drivers and the motors which increases the efficiency of heat dissipation. Preferably, the g-hardened PCB has a dedicated control circuit for each channel of the CAS which includes a microcontroller, motor control—DSP, motor driver—full bridge IC (BLDC).

Some embodiments of the invention comprise a grenade, mortar round or tank round having a forebody and an afterbody, tailfins on the afterbody, and at least one deployable flow effector, activatable flow effector or active flow control device forward of and in alignment with at least one of the tailfins, such that deployment or activation of the flow effector affects the flow of air around the tailfin to steer or maneuver the round. The spoiler or flow effector when deployed is to augment momentum mixing using passive or low frequency excitation, which enhances the boundary layer and subsequently the downstream flow structures. In the case of a forebody device, the actuator (strake) has been shown to act as a "vortex generator," which can be used to control forebody asymmetries and yawing moment at high angles of attack. In the case of an aftbody, the actuator (spoiler) has been shown to act as an "aero-brake," which can be used to generate pitching and yawing moments at low angles of attack. Preferably, the grenade, mortar round or tank round is fin stabilized and/or is shot out of a smooth-bore mortar, barrel, cannon or tube. Preferably, the mortar, barrel, cannon or tube is a short barrel. Preferably, the tailfins are deployable, and further preferably, when deployed, the tailfins extend beyond the caliber diameter of the round shell. Preferably, the deployable flow effector, activatable flow effector or active flow control device of this embodiment is a spoiler, but it might be, in various embodiments, any of the other effectors, devices or surfaces described elsewhere in this application. Preferably, the deployable flow effector, activatable flow effector or active flow control device of this embodiment is deployed and/or actuated on the command of a controller which has been programmed to process inputs from one or more sensors, including those listed above. In some such embodiments the grenade or mortar round further comprises deployable canards and preferably deployable, independently actuatable canards that act to steer the round during flight. Further preferably, these canards extend beyond the caliber diameter of the round shell. Also preferably, the grenade, mortar round or tank round has one or more mechanical or electrical components, including sensors, actuators and/or processors that have been g-hardened to survive the firing or launch impulse as described elsewhere in this application.

Other embodiments of the present invention comprise a munition round having a forebody, a midbody and an afterbody, tailfins on the afterbody, and deployable wings on the midbody. Preferably, the deployable wings are configured to deploy at dihedral angles. Also preferably, the munition round further comprises deployable, actuatable canards capable of generating lift on the munition round forebody during flight sufficient to lift the nose of the munition round and, in conjunction with the lift provided by the wings, cause the round to glide in departure from a traditional ballistic arc, thereby extending the range of the munition round. Preferably, the canards are independently actuatable such that they are capable of inducing roll in the munition round to steer it to a target. Preferably, the munition is a 120 mm mortar round. Preferably, the munition round is fin stabilized and/or is shot out of a smooth-bore mortar, barrel, cannon or tube. Preferably, the mortar, barrel, cannon or tube is a short barrel. The tailfins may be fixed or deployable or both (meaning, in the latter case, that the deployment extends, enlarges or cants the tailfins). Further preferably, the deployable wings and/or canards extend beyond the caliber diameter of the round shell. Also preferably, the grenade, mortar round or tank round has one or more mechanical or electrical components, including sensors, actuators and/or processors that have been g-hardened to survive the firing or launch impulse as described elsewhere in this application. Most preferably, this g-hardened component should be capable of surviving a firing or launch acceleration (setback load) of 16,000 g's.

Still other embodiments of the present invention comprise a munition round having a forebody and an afterbody, deployable tailfins on the afterbody, and deployable and actuatable canards on the forebody. Preferably, the canards are capable of generating lift on the munition round forebody during flight sufficient to lift the nose of the munition round and cause the round to glide in departure from a traditional ballistic arc, thereby extending the range of the munition round. Preferably the canards are independently actuatable such that they are capable of inducing roll in the munition round to steer it to a target. Preferably, the munition is a 40 mm grenade. Preferably, the munition round is fin stabilized and/or is shot out of a smooth-bore mortar, barrel, cannon or tube. Preferably, the mortar, barrel, cannon or tube is a short barrel. The tailfins may be fixed or deployable or both (meaning, in the latter case, that the deployment extends, enlarges or cants the tailfins). Further preferably, the deployable canards extend beyond the caliber diameter of the round (i.e., they are "supercaliber" when deployed). The span of the canard should be sufficiently long enough to be in the free stream flow (outside the boundary layer). This helps as a significant portion of the canard will then be present in the free stream—where the flow is expected to be clean (not turbulent). Also preferably, the grenade, mortar round or tank round has one or more mechanical or electrical components, including sensors, actuators and/or processors that have been g-hardened to survive the setback load as described elsewhere in this application. Most preferably, this g-hardened component should be capable of surviving setback loads of 18,000 g's.

Still other embodiments of the present invention comprise a short-barrel gun-fired munition comprising at least one activatable flow effector for extending the range and enhancing the precision of the munition, wherein the munition is fired from a short-barrel gun and experiences a launch or firing acceleration of more than 10,000 g's. More preferably, the munition experiences a launch or firing acceleration of more than 16,000 g's. Still more preferably, the munition experiences a launch or firing acceleration of more than 18,000 g's. Also preferably, the munition further comprises sensors consisting of at least one accelerometer, at least one magnetometer, at least one IR sensor, at least one rate gyroscope, and also comprises at least one microcontroller configured to process signals from the sensors and provide output to control the at least one activatable flow effector. Also preferably, the munition is equipped with a video camera in the nose of the munition. Also preferably, the at least one activatable flow effector comprises a canard that extends beyond the outer radius of the munition, and the munition further comprises an activatable wing that also extends beyond the outer radius of the munition. Usefully, the canard's angle of attack may be modified after deployment by a beveled geared reduction mechanism located inside of the munition body.

Still other embodiments of the present invention comprise a munition comprising a munition body having a forebody and an afterbody, at least one deployable fin on the afterbody, and at least one deployable flow effector on the forebody, wherein the at least one deployable fin is deployed after the munition's launch or ejection and the at least one deployable flow effector is subsequently deployed to affect air flow over the at least one deployable fin, thereby both extending the range and increasing the precision of the munition. The at least one deployable flow effector on the forebody may be a spoiler or a canard. Preferably, the canard is actuatable so that the canard's angle of attack may be modified after deployment by a beveled geared reduction mechanism located inside of the munition body. The munition is preferably a tank round, mortar round, artillery round, or grenade.

Still other embodiments of the present invention comprise a munition comprising a munition body having a forebody and an afterbody, at least two deployable dihedral wings on the munition body, and one or more deployable canards on the forebody, wherein the wings are deployed after the munition's launch or ejection and the one or more deployable canards are subsequently deployed to lift the forebody with respect to the afterbody and achieve a desired glide ratio, thereby increasing both the range and the precision of the munition. In some such embodiments, the deployable dihedral wings' angles of attack are advantageously independently modified after deployment by a beveled gear reduction mechanism located inside of the munition body. Likewise, the canards' angles of attack may be independently modified after deployment by a similar type beveled gear reduction mechanism located inside of the munition body. The munition may be a tank round, a mortar round, an artillery round, or a grenade.

Various features, steps, and embodiments of the present invention are described in greater detail in other related patents and patent applications under the Assignee of the present application. Some of these related patents and applications include methods and systems for extended range and enhanced precision described in U.S. patent application Ser. No. 15/489,859 and U.S. Pat. Nos. 9,658,040, 9,086,258, and 9,395,167. Other such related patents and patent applications include systems and methods for ballistic apogee detection described in U.S. patent application Ser. No. 15/590,101 and U.S. Pat. No. 9,677,864. Still other such related patents and patent applications include systems and methods for controlling flow on aircrafts, missiles and munitions described in U.S. patent application Ser. No. 15/211,346 and U.S. Pat. Nos. 9,429,400, 8,191,833, 7,977,615, 7,226,015, 7,070,144, and 6,685,143. Yet other such related patents and patent applications include hierarchical closed-loop flow control systems and methods described in U.S. patent application Ser. Nos. 15/057,211 and 11/311,767, as well as U.S. Pat. Nos. 9,310,166, 8,548,65, 8,417,395, 8,190,305, and 6,685,143. Each of the above patents and patent applications are hereby incorporated by reference.

One embodiment of the present invention includes a flight control system for missiles, munitions, and projectiles comprising: a control actuation system (CAS) comprising a lead screw and nut, at least one flow effector or control surface, and a deployment mechanism adapted to maintain a state of tension on the at least one flow effector or control surface until the tension is released and the at least one flow effector or control surface deploys; a configurable guidance sensor suite (CGSS) comprising an inertial measurement unit (IMU) adapted to measure flight data; and a transceiver adapted for two-way communication between the missile, munition or projectile and a remote user interface.

Another embodiment of the present invention includes a flight control system for missiles, munitions, and projectiles comprising: a modular and scalable control actuation system (CAS) comprising a lead screw and nut, at least one flow effector or control surface, and a deployment mechanism adapted to maintain a state of tension on the at least one flow effector or control surface until the tension is released and the at least one flow effector or control surface deploys; a configurable guidance sensor suite (CGSS) comprising at least one accelerometer, at least one gyroscope, and at least one magnetometer adapted to measure flight data; and a transceiver adapted for two-way communication between the missile, munition or projectile and a remote user interface.

Still another embodiment of the present invention includes a flight control system for missiles, munitions, and projectiles comprising: a control actuation system (CAS) comprising a lead screw and nut, at least one flow effector or control surface, and a deployment mechanism adapted to maintain a state of tension on the at least one flow effector or control surface until the tension is released and the at least one flow effector or control surface deploys; an image or video sensor; and a transceiver adapted for two-way communication between the missile, munition or projectile and a remote user interface.

Yet another embodiment of the present invention includes a flight control system for missiles, munitions, or projectiles comprising: a control actuation system (CAS) comprising at least one deployable flow effector or control surface, and a tension component adapted to maintain a state of tension on the at least one flow effector or control surface until the tension is released and the at least one flow effector or control surface deploys, the CAS further comprising at least one position component adapted to maintain the position of the at least one flow effector or control surface in position during flight after being deployed; a configurable guidance sensor suite (CGSS) comprising an inertial measurement unit (IMU) adapted to measure flight data; and a transceiver adapted for two-way communication between the missile, munition or projectile and a remote user interface, wherein the CAS, CGSS and transceiver are integrated into a single enclosure adapted to be placed within the missile, munition or projectile body.

Still yet another embodiment of the present invention includes a missile, munition, or projectile containing a flight control system comprising: a missile, munition or projectile body a modular and scalable control actuation system (CAS) adapted to be placed within the body of the missile, munition or projectile, the CAS comprising at least one deployable flow effector or control surface, and a deployment mechanism adapted to maintain a state of tension on the at least one flow effector or control surface until the tension is released and the at least one flow effector or control surface deploys; a configurable guidance sensor suite (CGSS) comprising at least one accelerometer, at least one gyroscope, and at least one magnetometer adapted to measure flight data; and a transceiver adapted for two-way communication between the missile, munition or projectile and a remote user interface.

Even yet another embodiment of the present invention includes a missile, munition, or projectile containing a flight control system comprising: a missile, munition or projectile body; a control actuation system (CAS) adapted to be placed within the body of the missile, munition or projectile, the CAS comprising at least one deployable flow effector or control surface, and a deployment mechanism adapted to maintain a state of tension on the at least one flow effector or control surface until the tension is released and the at least one flow effector or control surface deploys, the CAS further comprising at least one component adapted to maintain the position of the at least one flow effector or control surface in position during flight after being deployed; an image or video sensor; and a transceiver adapted for two-way communication between the missile, munition or projectile and a remote user interface.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF THE DRAWINGS

FIGS. 1A-C. Several views of a CAS design embodiment of the present invention including A) CAS with activated or deployed flow effectors, B), a cutaway view of CAS showing the drivetrain components, and C) CAS with stowed flow effectors.

FIGS. 13A-D. Graphs depicting flight data from a 40 mm round launch showing IMU sensor output for LV 40 mm, over about 7 seconds, including A) accelerometer data, B) gyroscope data, C) magnetometer data, and D) Euler angle data.

FIGS. 14A-C. Graphs depicting flight data from a 120 mm mortar test showing IMU sensor output, including A) acceleration data, B) angular rate data, and C) magnetic field data.

FIGS. 15A-F. Various embodiments of the CAS of the present invention scaled to fit various platforms including: A) 40 mm grenade, B) 120 mm mortar, C) 155 mm ERPT, D) 40 mm grenade, E) 120 mm mortar, F) 155 mm ERPT, and G) 40 mm rocket-assist projectile.

DETAILED DESCRIPTION OF THE INVENTION AND DRAWINGS

Various embodiments of the CAS of the present invention include several important components in various combinations. The components may include, but are not limited to, a motor (brushless or brushed DC motor, for example), encoder, a gear or gear system, lead screw, microcontroller, and motor driver or controller.

Now referring to the figures, FIGS. 1A-C depict several views of one design embodiment of the CAS 100 of the present invention. FIG. 1A depicts the CAS 100 with activated or deployed flow effectors 105. The depicted CAS 100 design is capable of operating and successfully activating or deploying the flow effectors even under high-g conditions after firing. High-g conditions include g-force loads of greater than 20,000 g's. FIG. 1A also depicts one embodiment of the CGSS 115 including IMU and transceiver components. FIG. 1B depicts a cutaway view of the CAS 100 embodiment including placement of key components described in greater detail in FIG. 2, as well as one embodiment of the CGSS 115 including IIU and transceiver components. FIG. 1C depicts the CAS 100 embodiment with stowed flow effectors 100 within the housing of the CAS, that is the flow effectors are unactuated or undeployed. When the flow effectors 110 are stowed, they are preferably flush or sub-flush to the surface of the munition, missile or projectile, which may include being within the body of the CAS 100. FIG. 1C also depicts one embodiment of the CGSS 115 including IMU and transceiver components, and although not specifically shown, an enclosure 120 depicted as a dotted line so that the internal components of the CGSS and CAS may be seen.

Figure 2:
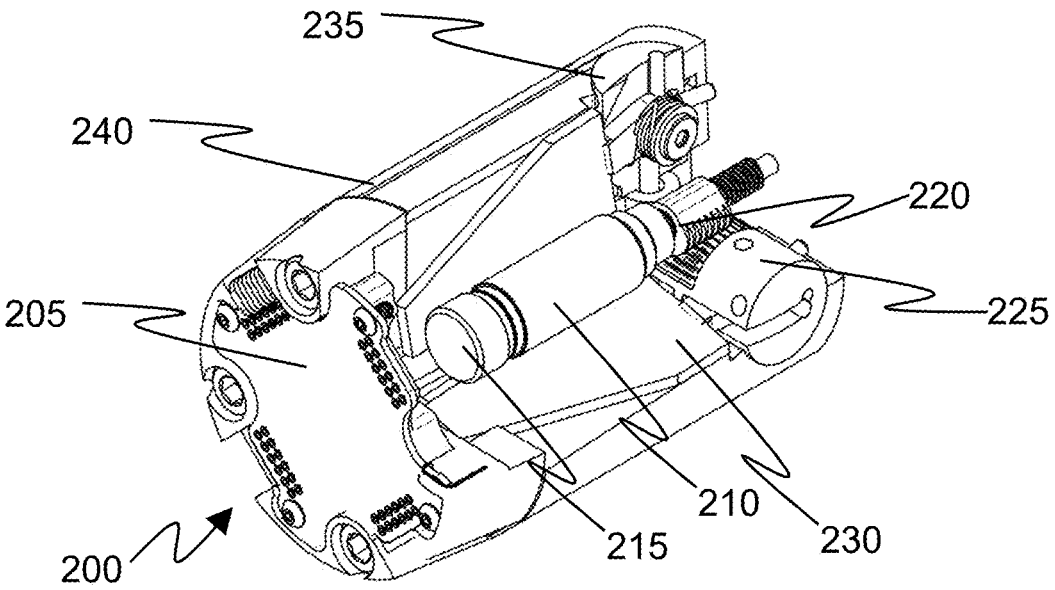
FIG. 2. Cutaway view of one embodiment of a CAS depicting important components and their placement within the CAS.

FIG. 2 depicts a cutaway view of a CAS 200 embodiment showing several important components of the CAS including the control electronics 205, the motor 210, which in the depicted embodiment is a BLDC motor, encoder 215, lead screw and nut 220, flow effector or control surface barrel gear 225, flow effector or control surface 230, deployment mechanism 235, and CAS housing 240. The CAS 200 housing 240 preferably is a customized or customizable aero-shell that can provide various mounting options for the CAS 200 to be mounted into numerous types of munitions, missiles and projectiles.

An important consideration for the present invention to provide precision flight control is attaining positional feedback from flow effectors or control surfaces 230, which is achieved through an encoder 215 on the motor 210. The depicted encoder 215 has 256 counts per revolution with 3 channels, and uses differential EIA RS 422 driver logic. This encoder 215 has been tested for shock successfully up to levels greater than 20,000 g's. The encoder 215 package is housed in an aluminum structure and welded to the motor 210/gear stack 225 to increase robustness.

The CAS 200 includes stow/deploy capability to survive the high-spin and high-g launch environment—the flow effectors or control surfaces 230 may be deployed and/or retracted as needed.

The CAS 200 preferably minimizes weight and survivability through optimal material selection. The CAS 200 housing 240 may be made of various materials known in the art to be strong yet lightweight, and in at least one embodiment the housing 240 is constructed of Grade 5 Titanium as one example, while the forward and aft bulkheads may use Al7075T*. The flow effectors or control surfaces 230 are preferably made of either titanium or aluminum, but may be constructed of other materials that have the potential to increase performance in the specified aerodynamic environment.

Figure 3:
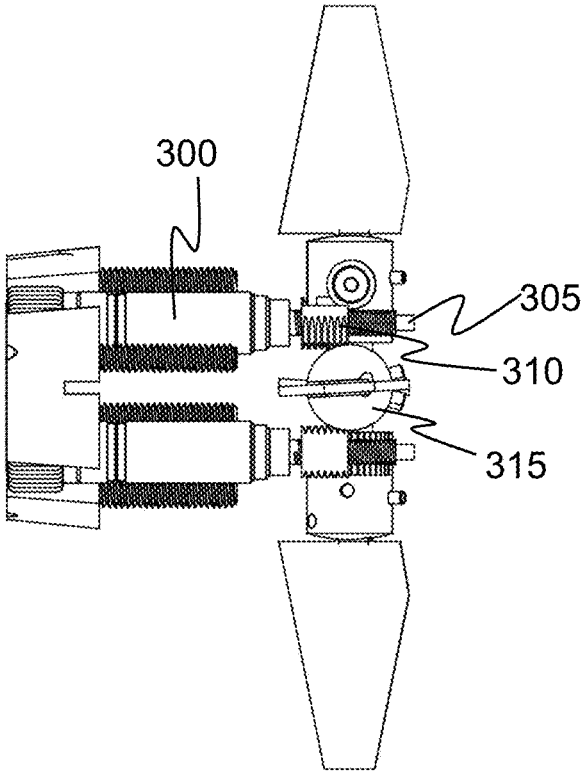
FIG. 3. Close up view of single axis of CAS showing interaction between motor to lead screw to flow effector barrel. Left is forward (nose), right is aft (tail).

FIG. 3 depicts a close-up interior view of a single axis of one embodiment of the CAS. The motor 300, a BLDC in the depicted embodiment, interacts with the lead screw 305, which, in turn, drives the lead screw nut 310. The interaction between these components is then translated to the flow effector barrel 315 to drive the flow effector to move. The flow effector may be deployed or retracted utilizing these components.

Figure 4:
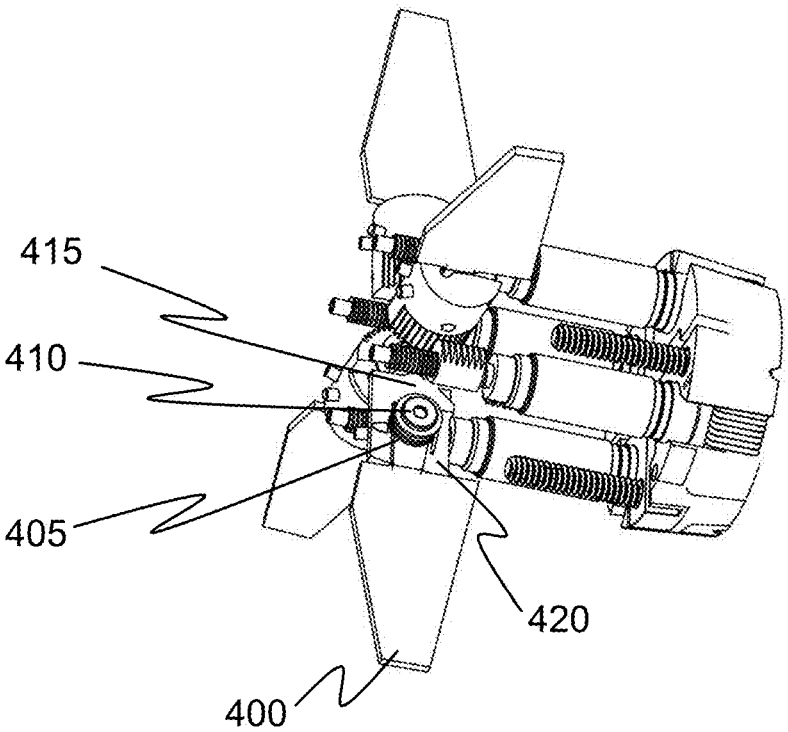
FIG. 4. Diagram of one embodiment of a flow effector or control surface deployment mechanism.

FIG. 4 is a diagram of one embodiment of the deployment mechanism for the flow effectors or control surfaces of the present invention. The flow effectors or control surfaces 400 are attached to the flow effector or control surface barrel 420 via a shoulder bolt 410. The flow effector or control surface 400 is mounted in a state of tension courtesy of a tension component, depicted in the present figure as a torsion spring with a lock 405 such that when the flow effector or control surface 400 is stowed, the torsion spring provides tension that, when released, allows the flow effector or control surface 400 to activate or deploy. A spring-loaded locking pin 415 is disposed such that, when the flow effector or control surface 400 is deployed, the locking pin moves into place or otherwise is situated to prevent the flow effector or control surface 400 from retracting unintentionally, such as due to recoil from deployment or due to high g-forces against the flow effector or control surface 400.

When stowed, the mechanical design is such that the non-operational spin rate will not cause a pre-trigger deployment. This deployment mechanism minimizes components and utilizes the motors to drive the canards into a deployed state when commanded. This rotation allows the internal torsion spring to release the flow effector or control surface 400 out and they continue to travel until they reach the full-stop. At this stop, a ball-detent is used to pin and hold the flow effector or control surface in the deployed state. This mechanism reduces recoil chances and allows for smooth deployment of the flow effector or control surface into the airstream in the forward-to-aft direction, leveraging the airflow to assist in deployment.

Figure 5A:
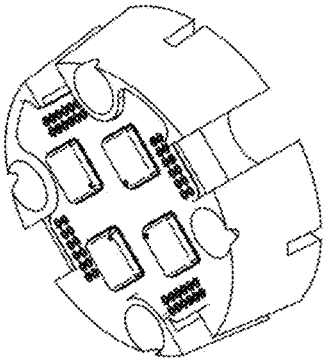
FIGS. 5A-C. Picture depicting one embodiment of the control electronics for the CAS of the present invention.
Figure 5B:
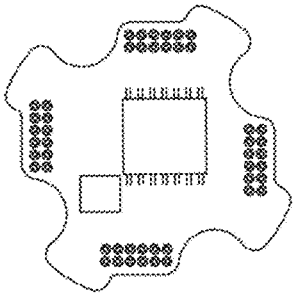
Figure 5C:
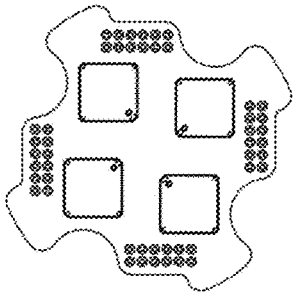

FIGS. 5A-C depict several views of one embodiment of the control electronics. FIG. 5A shows the control electronics interfaced with the forward bulkhead of the CAS. FIG. 5B shows a bottom-view of the control electronics, including a microcontroller and 422-driver. FIG. 5C depicts a top view of the control electronics including controls/drive integrated circuits for DC motors.

Figure 6:
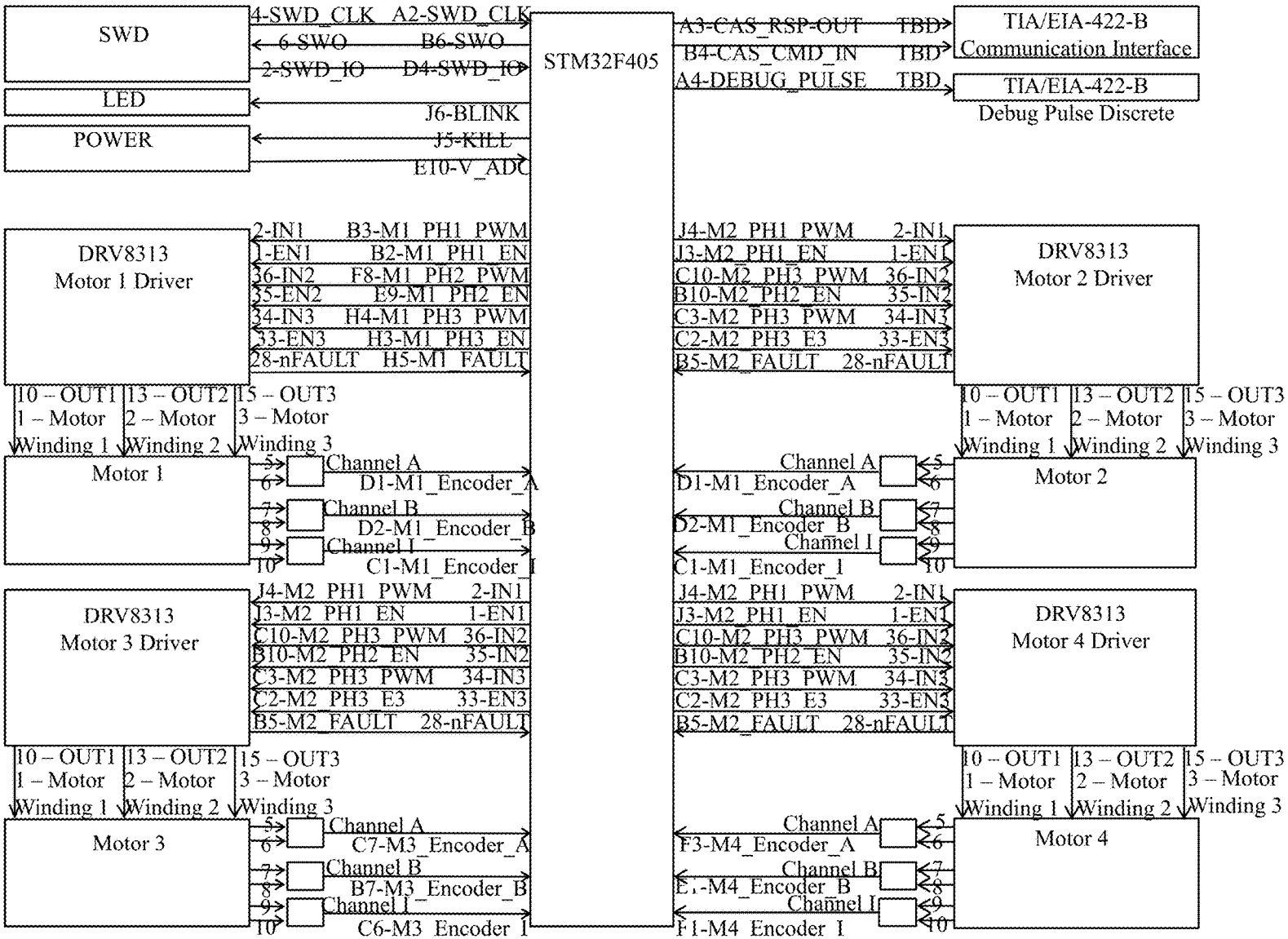
FIG. 6. Block diagram of control electronics and firmware architecture of one embodiment of the present invention.
Figure 7A:
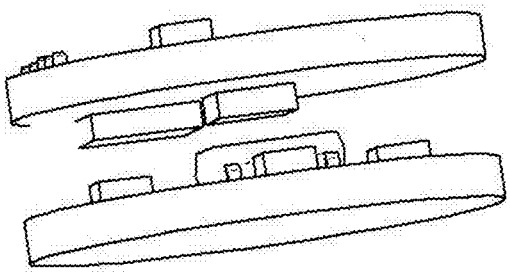
FIGS. 7A-D. Several views of one embodiment of the IMU of the present invention depicting various sensors, such views including A) perspective view, B) circuit diagram, C) side view, and D) top view.
Figure 7B:
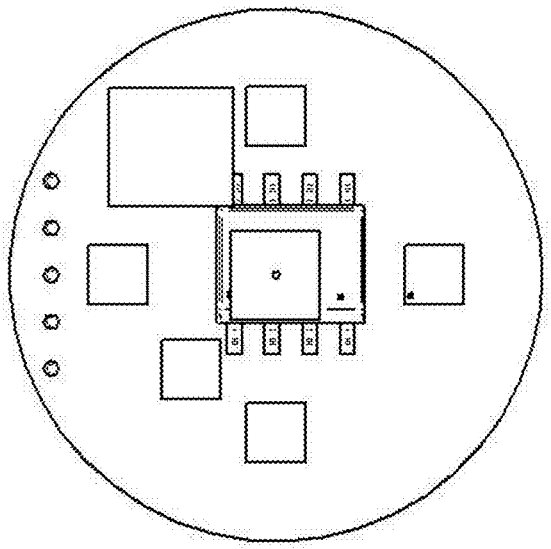
Figure 7C:
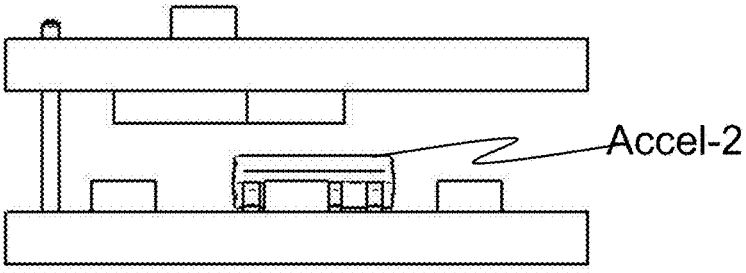
Figure 7D:
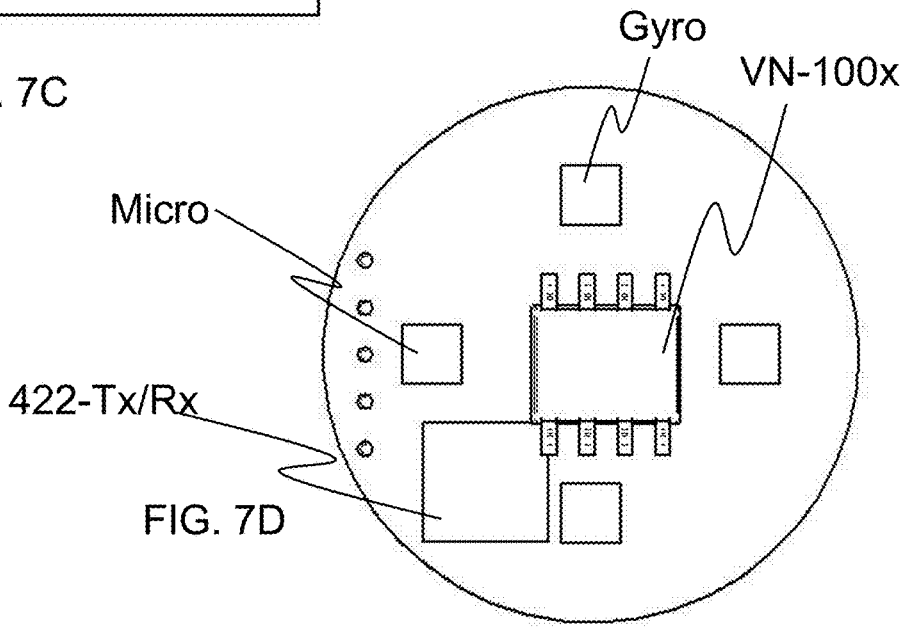
Figure 8A:
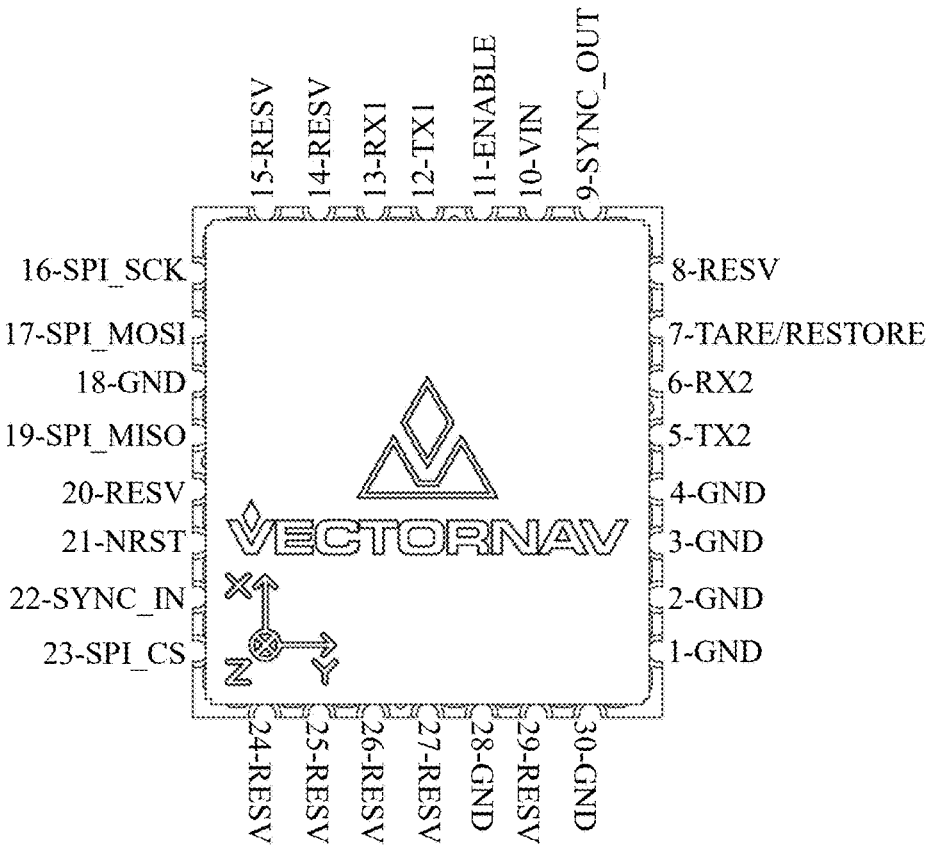
FIGS. 8A-D. Pinout designs for various components of one embodiment of the IMU of the present invention, including A) VN-100x, B) ADXL2780-50g, C) FXAS21002-Gyro, and STM32F4050GY.
Figure 8B:
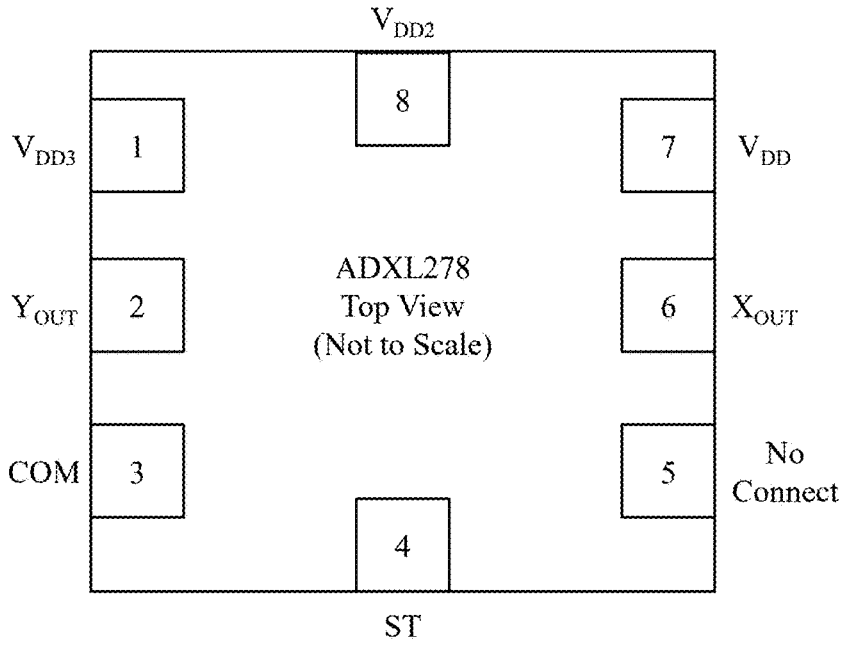
Figures 8C, 8D:
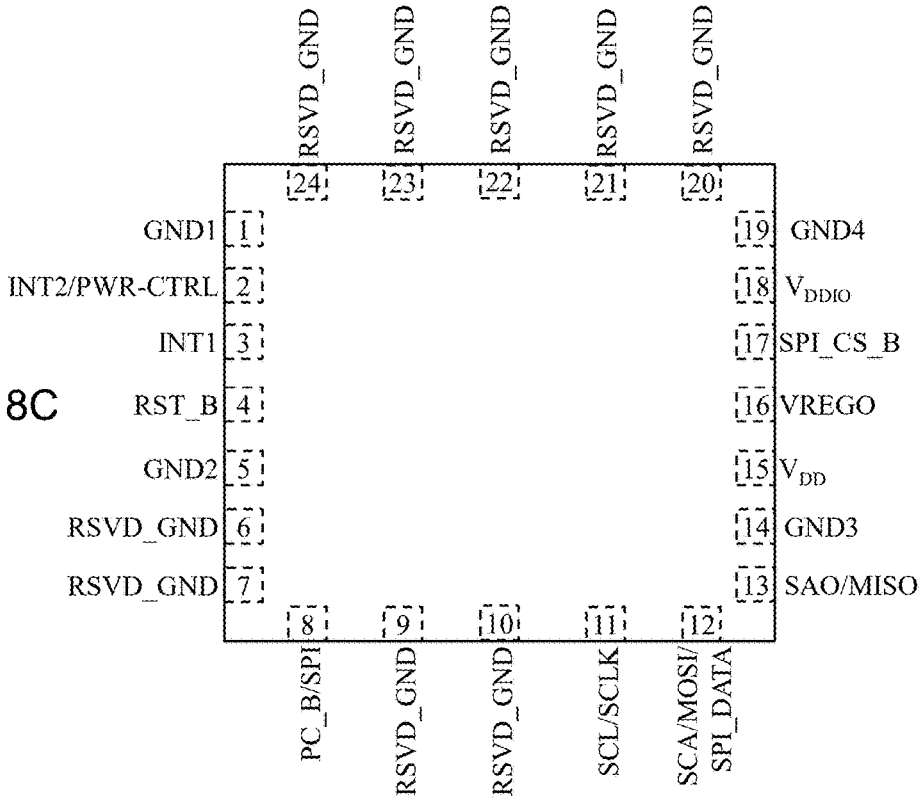

FIG. 6 is a block diagram of control electronics and firmware architecture of one embodiment of the present invention. The control electronics, as for the depicted embodiment, support a 4-channel CAS for various munitions, missiles or projectiles. The control electronics, and thus the CAS, preferably do not initiate any messages, but rather primarily receive and respond to commands from a host system, such as the munition, missile or projectile or other components thereof. Such commands input to the control electronics and CAS may include, but are not limited to, motor commands and commands to retrieve the current motor position. Responses or outputs of the control electronics and CAs may include, but are not limited to, positioning or repositioning the motor, returning information regarding the position of the motor or invalid command responses.

FIGS. 7A-D include several views of one embodiment of the IMU of the present invention depicting various sensors, such views including A) perspective view, B) circuit diagram, C) side view, and D) top view. In the various views of the IMU, sensors including multi-axis accelerometers, gyroscopes, and a separate integrated sensor suite can be seen, as well as a microcontroller. The separate integrated sensor suite includes one or more of an accelerometer, gyroscope, magnetometer and DSP.

FIGS. 8A-D depict pinout designs for various components of one embodiment of the IMU of the present invention, including A) separate integrated sensor suite or package, B) accelerometer(s), C) gyroscope(s), and STM32F405OGY.

Figure 9:
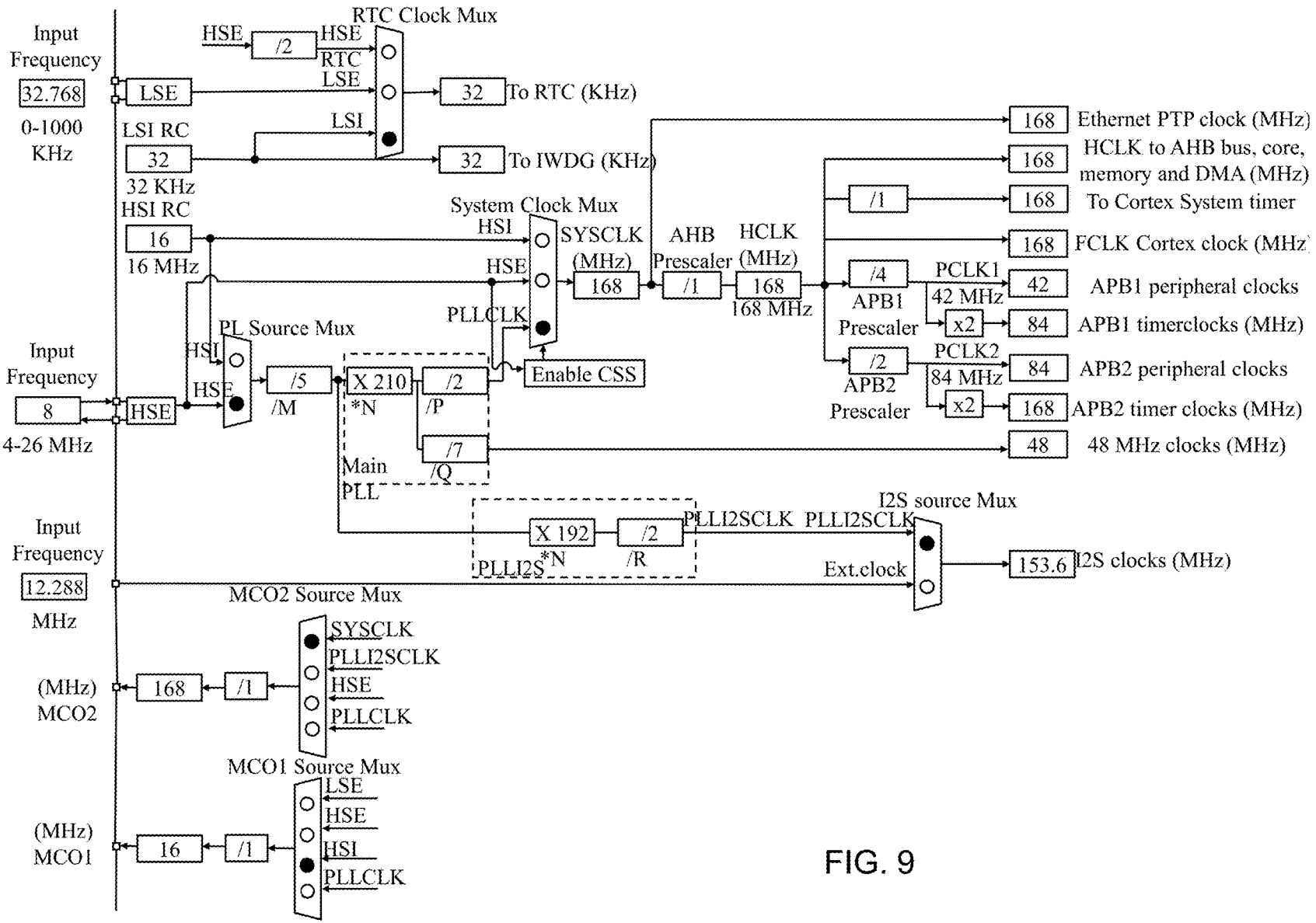
FIG. 9. Clock tree configuration for one embodiment of the IMU of the present invention.

FIG. 9 depicts a block diagram of clock tree configuration for one embodiment of the IMU of the present invention. This diagram shows one embodiment the IMU clock tree configuration that can be used for analysis and/or simulation, and can provide a basis for further development of the IMU.

Figure 10:
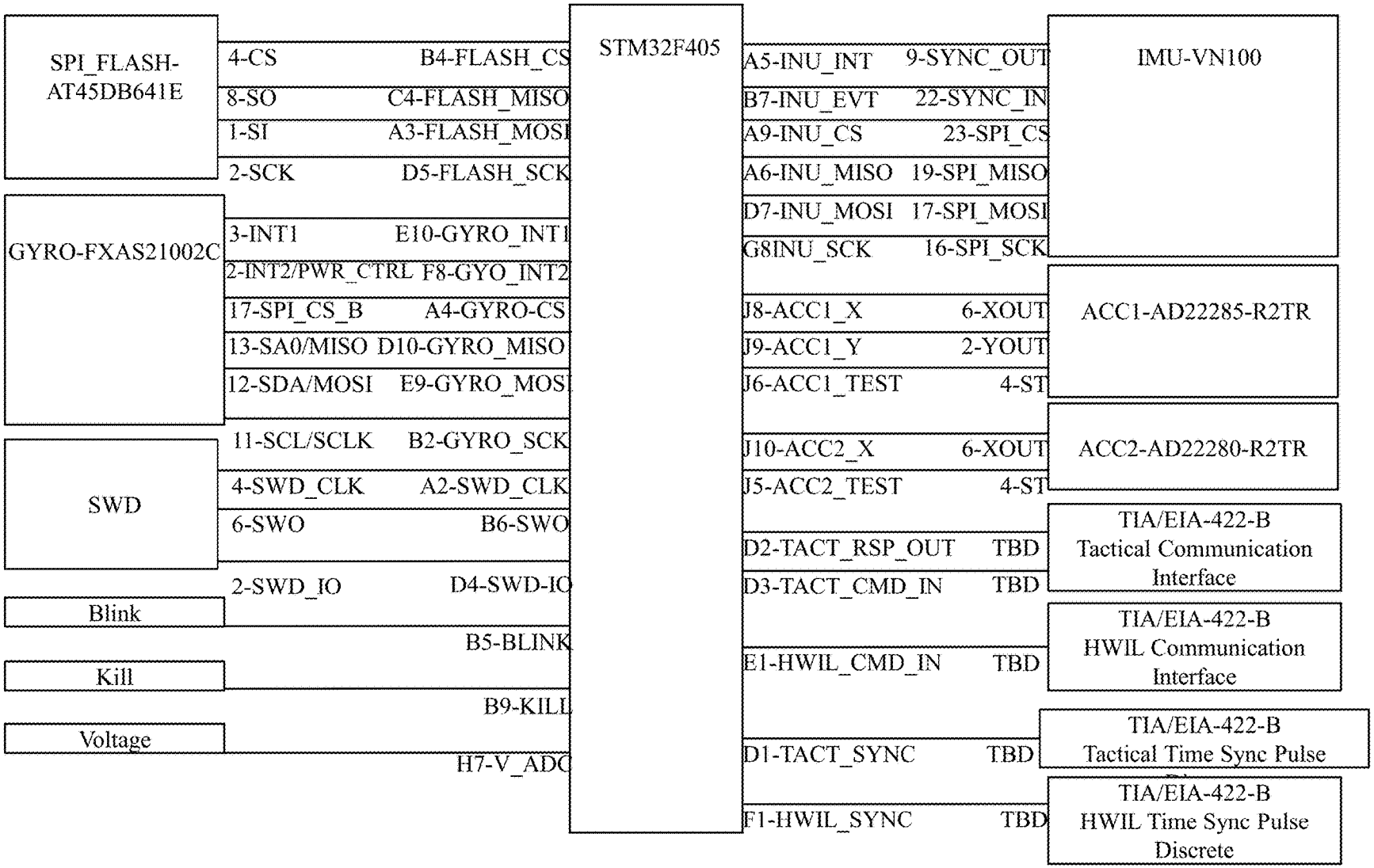
FIG. 10. Block diagram of one embodiment of the IU of the present invention showing communication architecture between subsystems and components.
Figure 11:
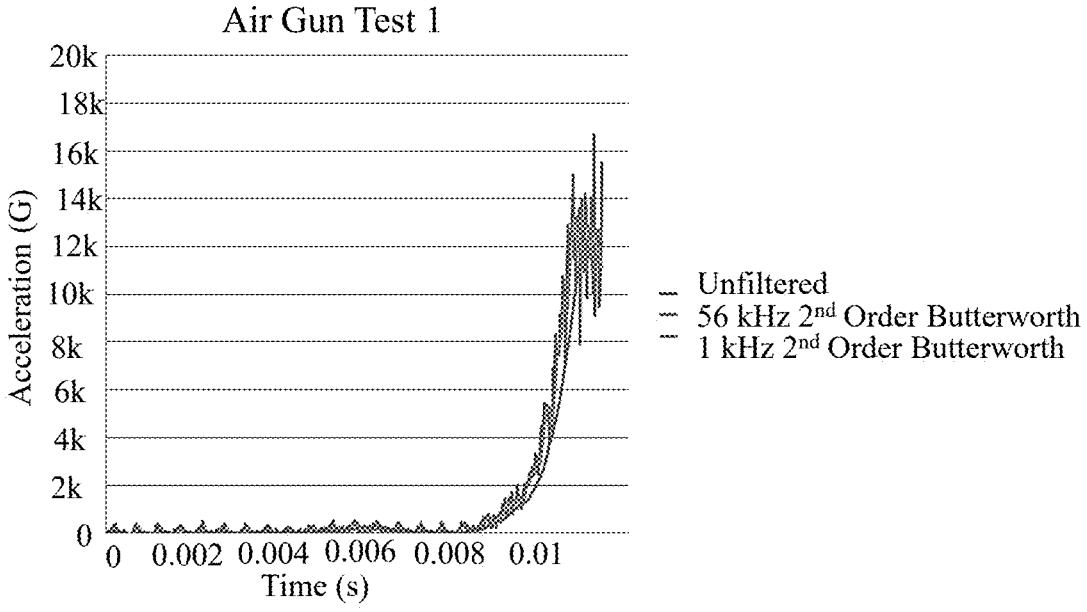
FIG. 11. Graph depicting test data resulting from air gun tests of rounds fired using one embodiment of each of the CAS and IMU of the present invention.

FIG. 10 is a block diagram of one embodiment of the IU of the present invention showing communication architecture between subsystems and components FIG. 11 is a graph depicting test data resulting from air gun tests of rounds fired using the CAS and IMU of the present invention. The graph demonstrates that the CAS and IMU of the present invention exhibits high survivability and calibration ability, even under high-g effects.

Figure 12:
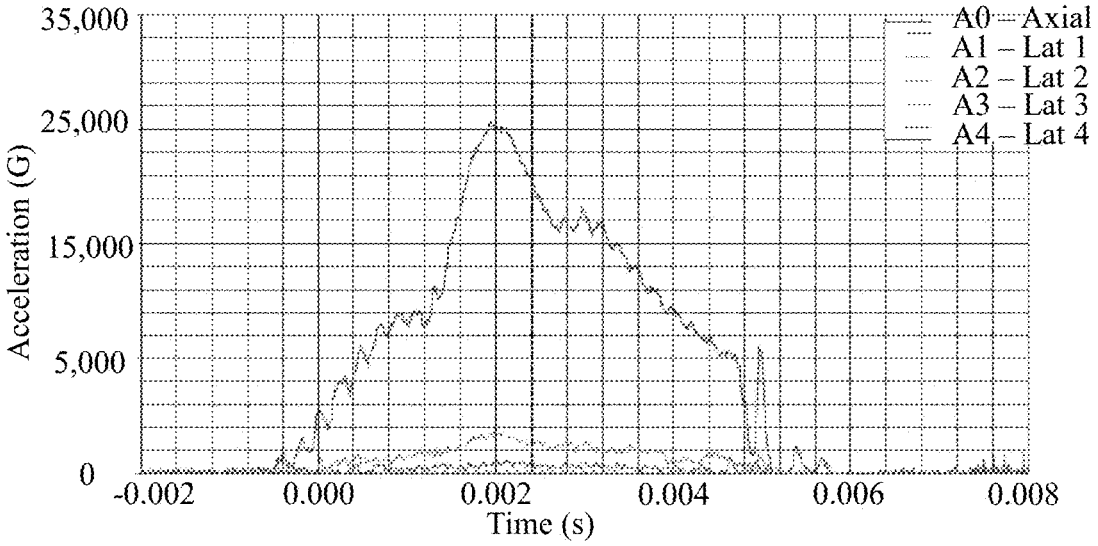
FIG. 12. Graph depicting test data resulting from a 155 mm gun launch of rounds fired using one embodiment of each of the CAS and IMU of the present invention.

FIG. 12 is a graph depicting test data resulting from a 155 mm gun launch of rounds fired using one embodiment the CAS and IU of the present invention. The test data demonstrates survivability and operation of the CAS and IMU during and after a gun-launch event in high-g conditions up to about 25,000 g's.

FIGS. 13A-D Graphs depicting flight data from a 40 mm round launch showing IMU sensor output for LV 40 mm, over about 7 seconds. FIG. 13A shows accelerometer data from a live fire test utilizing a 40 mm round with an embodiment of the IMU mounted therein. FIG. 13B shows gyroscope data from a live fire test utilizing a 40 mm round with an embodiment of the IMU mounted therein. FIG. 13C shows magnetometer data from a live fire test utilizing a 40 mm round with an embodiment of the IMU mounted therein. FIG. 13D shows Euler angle data from a live fire test utilizing a 40 mm round with an embodiment of the IMU mounted therein.

FIGS. 14A-C Graphs depicting flight data from a 120 mm mortar test showing IMU sensor output. FIG. 14A shows acceleration data from a 120 mm mortar test with an embodiment of the IMU mounted in the round. FIG. 14B shows angular rate data from a 120 mm mortar test with an embodiment of the IMU mounted in the round. FIG. 14C shows magnetic field data from a 120 mm mortar test with an embodiment of the IMU mounted in the round.

FIGS. 15A-G are pictures of various embodiments of the CAS of the present invention scaled to fit various platforms including: 15A) 40 mm grenade, 15B) 120 MM mortar, 15C) 155 mm ERPT, 15D) 40 mm grenade, 15E) 120 mm mortar, 15F) 155 mm ERPT, and 15G) 40 mm rocket-assist projectile. FIG. 15A shows a 4-channel CAS for a 40 mm grenade. FIG. 15B shows a 4-channel CAS for a 120 mm mortar. FIG. 15C shows a 2-channel CAS for a 155 mm ERPT. FIG. 15D shows a 2-channel CAS for a 40 mm grenade. FIG. 15E shows a 2-channel CAS for a 120 mm mortar. FIG. 15F shows a 2-channel CAS for a 155 mm ERPT. FIG. 15G shows a 4-channel 40 mm rocket-assist projectile with one embodiment of a CAS of the present invention.

Figure 16:
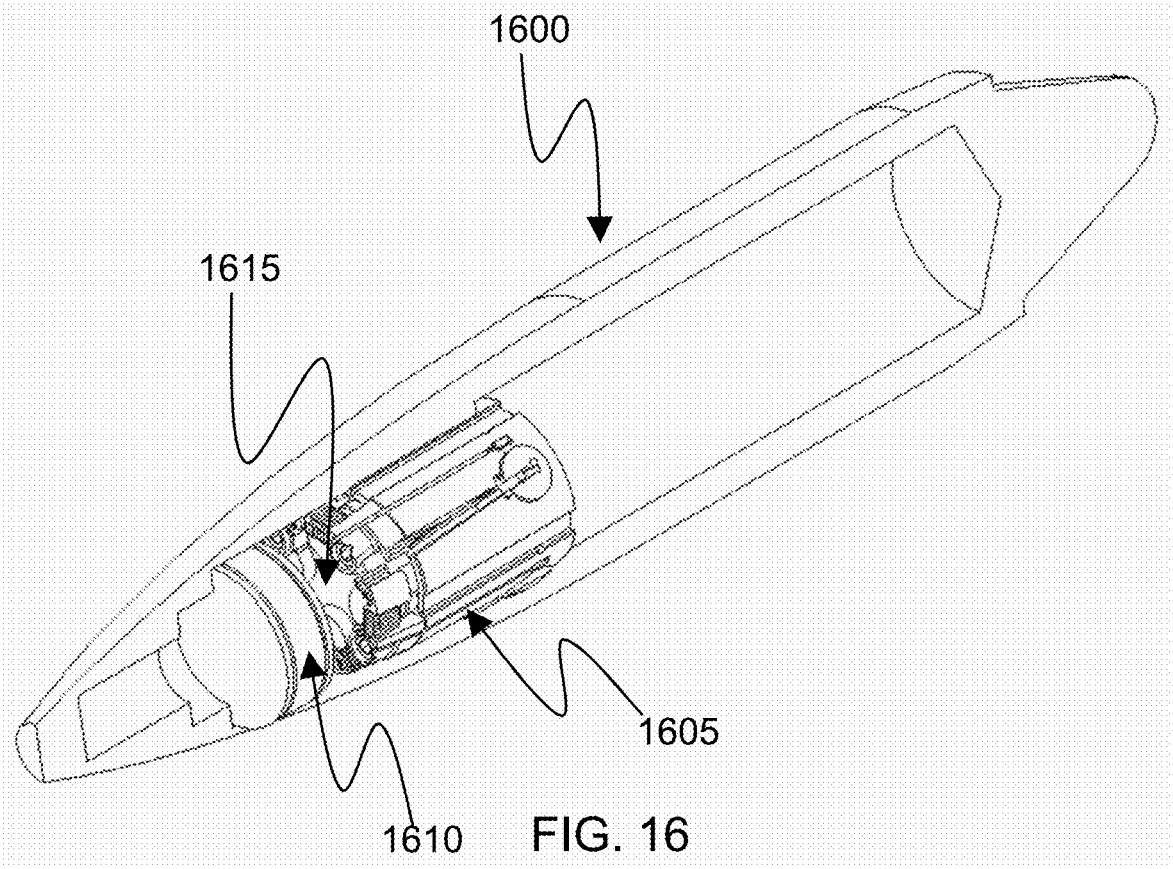
FIG. 16. Cross-sectional view of one embodiment of a missile, munition, or projectile depicting the CAS and CGSS as oriented within an enclosure of the missile, munition, or projectile.

FIG. 16 depicts a cross-sectional view of a missile, munition, or projectile. The missile, munition, or projectile comprises a body or enclosure 1600, in which are housed a control actuation system (CAS) 1605 and a configurable guidance sensor suite (CGSS) 1610. The CAS 1605 is similar to that depicted in FIGS. 1A-C, and 2-4. The CGSS 1610 depicted in the present figure is similar to the IMU unit depicted in FIGS. 7A-7D, but may comprise additional sensors or components as described herein, and is depicted enclosed in potting material. The CGSS comprises one or more of the IMU units along with any additional sensors, and interfaces with the control electronics 1615 which are depicted as another embodiment of the control electronics of FIGS. 5A-C and 6.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

The invention claimed is:

1. A flight control system for missiles, munitions, or projectiles comprising:

a control actuation system (CAS) comprising at least one deployable flow effector or control surface, and a deployment mechanism adapted to maintain a state of tension on the at least one flow effector or control surface until the tension is released and the at least one flow effector or control surface deploys, the CAS further comprising at least one position component adapted to maintain the position of the at least one flow effector or control surface in position during flight after being deployed;

a configurable guidance sensor suite (CGSS) comprising at least one inertial measurement unit (IMU) adapted to measure flight data;

at least one image or video sensor adapted to provide real-time image or video data;

a transceiver adapted for two-way communication between the missile, munition, or projectile and a remote user interface; and a situational awareness subsystem comprising the at least one image or video sensor and the transceiver, the situation awareness subsystem adapted to transmit the real-time image or video data via the transceiver to a user to provide terminal guidance to the missile, munition, or projectile via the remote user interface, wherein the CAS, CGSS and transceiver are integrated into a single enclosure adapted to be placed within a missile, munition, or projectile body.

2. The flight control system of claim 1, wherein the CAS further comprises a motor, a planetary gear, and an encoder adapted to interface with the at least one position component, the at least one position component being a lead screw and lead nut adapted to prevent backdrive of deployed flow effectors or control surfaces caused by aerodynamic forces during flight such that the flow effectors or control surfaces remain in position without requiring power.

3. The flight control system of claim 2, wherein the flight control system is adapted to withstand forces greater than 20,000 g.

4. The flight control system of claim 3, wherein the CAS is modular and scalable with respect to the deployment mechanism and the position component associated with the at least one deployable flow effector, as well as orientation and gearing of the at least one motor adapted to manipulate the at least one deployable flow effector.

5. The flight control system of claim 4, wherein the CAS is adapted to be scalable to include 2, 3, or 4 deployable flow effectors or control surfaces.

6. The flight control system of claim 3, wherein the situational awareness subsystem is further adapted to perform target prioritization in flight, including target detection, identification, and tracking, and where the terminal guidance is based on the in-flight target prioritization.

7. A missile, munition, or projectile containing a flight control system comprising:

a missile, munition, or projectile body;

a modular and scalable control actuation system (CAS) adapted to be placed within the body of the missile, munition, or projectile, the CAS comprising at least one deployable flow effector or control surface, and a deployment mechanism adapted to maintain a state of tension on the at least one flow effector or control surface until the tension is released and the at least one flow effector or control surface deploys;

a configurable guidance sensor suite (CGSS) comprising at least one accelerometer, at least one gyroscope, and at least one magnetometer, together adapted to measure flight data;

at least one image or video sensor adapted to provide real-time image or video data;

a transceiver adapted for two-way communication between the missile, munition, or projectile and a remote user interface; and a situational awareness subsystem comprising the at least one image or video sensor and the transceiver, the situation awareness subsystem adapted to transmit the real-time image or video data via the transceiver to a user to provide terminal guidance to the missile, munition, or projectile via the remote user interface.

8. The flight control system of claim 7, further comprising at least one component adapted to maintain the position of the at least one flow effector or control surface in position during flight after being deployed, such component being a lead screw and lead nut adapted to prevent backdrive of deployed flow effectors or control surfaces caused by aerodynamic forces during flight such that the flow effectors or control surfaces remain in position without requiring power, wherein the CAS further comprises a motor, a planetary gear, and an encoder adapted to interface with the at least one component adapted to maintain the position of the at least one flow effector or control surface in position during flight after being deployed.

9. The flight control system of claim 8, wherein the flight control system is adapted to withstand forces greater than 20,000 g.

10. The flight control system of claim 9, wherein the CAS is scalable with respect to the deployment mechanism associated with the at least one deployable flow effector, orientation and gearing of the motor adapted to manipulate the at least one deployable flow effector.

11. The flight control system of claim 9, wherein the CAS, CGSS, and transceiver are integrated into a single enclosure adapted to be placed within the missile, munition, or projectile body.

12. The flight control system of claim 11, wherein the situational awareness subsystem is further adapted to perform target prioritization in flight, including target detection, identification, and tracking, and where the terminal guidance is based on the in-flight target prioritization.

13. The flight control system of claim 12, further comprising the image or video sensor adapted to provide real-time, in-flight video signals wherein the remote user interface is adapted to receive signals and data from the transceiver and to allow the user to control flight of the missile, munition, or projectile, based at least in part on the real-time, in-flight video signals from the image or video sensor, and at least in part on measured flight data from the CGSS and/or at least one IMU.

14. A flight control system for missiles, munitions, or projectiles comprising:

a control actuation system (CAS) comprising at least one deployable flow effector or control surface, and a deployment mechanism adapted to maintain a state of tension on the at least one flow effector or control surface until the tension is released and the at least one flow effector or control surface deploys, the CAS further comprising at least one component adapted to maintain the position of the at least one flow effector or control surface in position during flight after being deployed;

a configurable guidance sensor suite (CGSS) comprising at least one accelerometer, at least one gyroscope, and at least one magnetometer, together adapted to measure flight data;

at least one image or video sensor adapted to provide real-time image or video data;

a transceiver adapted for two-way communication between the missile, munition, or projectile and a remote user interface; and a situational awareness subsystem comprising the at least one image or video sensor and the transceiver, the situation awareness subsystem adapted to transmit the real-time image or video data via the transceiver to a user to provide terminal guidance to the missile, munition, or projectile via the remote user interface, wherein the CAS, CGSS and transceiver are integrated into a single enclosure adapted to be placed within a missile, munition, or projectile body.

* * * * *